US005311924A

United States Patent [19]

Asano et al.

[11] Patent Number: 5,311,924

[45] Date of Patent: May 17, 1994

[54] MOLTEN METAL LEVEL CONTROL METHOD AND DEVICE FOR CONTINUOUS CASTING

[75] Inventors: Kazuya Asano; Takayuki Kaji; Kazuo Arai; Shuji Tanaka; Michio Ibaraki; Yuki Nabeshima; Hiromitsu Yamanaka; Masaki Takashi; Saburo Moriwaki; Mototatsu Sugizawa; Hiroshi Nomura; Masayuki Onishi, all of Chiba, Japan

[73] Assignee: Kawasaki Steel Corporation, Hyogo, Japan

[21] Appl. No.: 30,149

[22] PCT Filed: Sep. 12, 1991

[86] PCT No.: PCT/JP91/01210

§ 371 Date: Mar. 18, 1993

§ 102(e) Date: Mar. 18, 1993

[51] Int. Cl.[5] ..... B22C 19/04

[52] U.S. Cl. ..... 164/453; 164/155.1

[58] Field of Search ..... 164/453, 449, 156; 222/590

[56] References Cited

U.S. PATENT DOCUMENTS 4,573,128 2/1986 Mazur ..... 164/453

4,583,717 4/1986 Hasegawa ..... 164/453

FOREIGN PATENT DOCUMENTS 56-141953 11/1981 Japan .
59-27762 2/1984 Japan .
59-30460 2/1984 Japan .
60-144 1/1985 Japan .
60-45026 10/1985 Japan .
62-168652 7/1987 Japan .
63-1925 1/1988 Japan .
63-16219 4/1988 Japan .
63-192545 8/1988 Japan .
1-293961 11/1989 Japan .
2-303664 12/1990 Japan .
3-110051 5/1991 Japan .

*Primary Examiner*—Paula A. Bradley
*Assistant Examiner*—Rex E. Pelto
*Attorney, Agent, or Firm*—Oliff & Berridge

[57] ABSTRACT

A method and apparatus is provided for stabilizing the molten metal surface in a mold. The invention is used to improve the quality of the casting slab by modifying a controlling parameter according to the detected slab drawing speed and the actual nozzle flowing characteristics calculated by the measured molten metal surface level and the nozzle opening degree.

13 Claims, 25 Drawing Sheets

MOLTEN METAL LEVEL CONTROL METHOD AND DEVICE FOR CONTINUOUS CASTING

FIELD OF THE INVENTION

The present invention relates to a molten metal level control method and device for continuous casting. More particularly, the present invention relates to a molten metal level control method and device which, through the use of a continuous casting machine equipped with an actuator such as a stopper or a sliding nozzle used to control the input flow of molten metal into the mold, are ideal for use in the continuous production of ingots such as slabs and billets and allow a systematic approach to various types of disturbances such as nozzles clogged with deposits, peeling off of these deposits and irregular bulging. In addition, stable and satisfactory control of molten metal level fluctuations in the mold is provided so that it is possible to deal with play of the actuator.

PRIOR ART

A continuous casting machine, which produces continuous ingots such as slabs and billets from molten metal, may have a configuration similar to that shown in FIG. 21, where molten metal 10 in a ladle 12 passes through a tundish 14 and a nozzle 16 and is then injected into a mold 18. The water-cooled mold 18 causes the surface layers of the molten metal to solidify. The partly solidified steel is then pulled out of the mold using pinch rolls 20. After the steel is further cooled to solidify further, it is cut into pieces of a specified length using a cutter 22 to produce ingots 24 which are then fed to the downstream rolling process.

For continuous casting machines it is very important to secure stability of the level of the molten metal 10 in the mold 18 to ensure good quality ingots. That is, molten metal level fluctuations cause enclosures such as refractory materials and molten slug to be caught up in the molten metal and to be captured in the skin of the solidified ingot 24. This may lead to defects caused by the formation of pinholes and enclosures under the skin and give rise to cracks caused by non-uniform heat relief. Accordingly, for continuous casting the molten metal level is generally controlled to remain constant. This is done by receiving signal from a molten metal level gauge 26 which detects the molten metal level in the mold 18 and by using a stopper 28 or a sliding nozzle to serve as flow control actuator. In recent years, the casting speed has increased so that molten metal level control has gained in importance.

In the past, molten metal level control has generally been carried out by using a molten metal level control system similar to that shown in FIG. 22. The system shown in FIG. 22 comprises a stopper 28 which is an actuator used to control the flow by throttling the flow path from the tundish 14 to the mold 18, a stopper controller 30 which controls the stopper 28 so that it establishes a desired position, a molten metal level gauge 26 which is used to detect the molten metal level in the mold 18, a molten metal level target setting device 32, a comparator 34 which compares the measured value to the target of the molten metal level and outputs the deviation e, and a PID (proportional integral and differential) controller 36 which calculates a stopper position command value u used to eliminate the deviation e by using pre-determined control parameters. For example, Japanese Laid-Open Applications 59-30460 and 63-192545 disclose this kind of molten metal level control.

The operation of such a molten metal level control system is shown in FIG. 23. That is, the molten metal level gauge 26 measures the molten metal level L, comparator 34 computes the deviation e (=Lref−L) of the measured value L from the molten metal level target Lref and, based on this deviation e, the PID controller 36 sends a stopper position command value u to the stopper controller 30. The molten metal level L is then controlled by the stopper controller 30, which causes the stopper 28 to establish a position in accordance with the command value u, and by adjusting the flow q of molten metal, where q is determined by the flow gain Gc which represents the relation between the stopper position x (in the example shown in FIG. 23, x is equal to the output of the stopper controller 30) and the amount of flow of molten metal which flows into the mold. That is, control is achieved by constantly monitoring and feeding back the measured value L of the molten metal level In FIG. 23, $\partial Qo/\partial V$ denotes an influence coefficient which describes the influence of the casting speed V on the amount of flow Qo of molten metal flowing out of the mold.

In some cases a so-called sliding nozzle, that is a pair of two plates each having formed therein a hole, is used as an actuator to control the flow of molten metal into the mold by sliding these plates. The basic method of control using these plates is much the same as the control method that uses the stopper.

In an actual continuous casting machine, alumina may adhere to the inside of the nozzle 16 at the outlet of the tundish 14 causing clogging of the nozzle and deposits may suddenly peel off. Also, disturbances caused by alumina adhering around the location where the stopper 28 and the tundish 14 come into contact or abrasion of the stopper 28 and the nozzle 16 may occur. This may cause a significant change in the flow gain Gc, which represents the characteristic relation between the stopper position and the input flow into the mold. This change in turn may cause a significant change in the flow.

Also, in the lower portion of a continuous casting machine, molten metal in the ingot may be pushed upwards, due to periodical expansion and contraction of the ingot 24 in between its support rolls 21. This phenomenon is called irregular bulging and may cause molten metal level fluctuations.

A major problem, however, is that the above-described conventional PID control system cannot cope with these phenomena. That is, in the molten metal level control model used in continuous casting, an integral dominates the characteristics of the system since the flow into the mold is integrated to yield the molten metal level. Accordingly, differential operation is an effective method to maintain the molten metal level, but as it is in general strongly sensitive to the influence of noise, it is difficult to use a desired high gain. Thus, just using a simple PID controller is not enough to obtain stable and good results.

To solve this problem Japanese Laid-Open Application 63-1925 provides a gain compensation means which uses a flow gain estimate G1, which is estimated on the basis of the measured values of the molten metal level, the stopper opening and the ingot casting speed, to compute from the following formula a correction value u' for the output u from the feedback control means.

$$u' = (K10/G1)\ u \quad (1)$$

where K10 is a positive constant.

Also, the abstract (hereinunder referred to as CAMP-ISIJ-245) of the lecture number 245 on page 308 of the proceedings of the 117th spring meeting of the Japan Iron and Steel Federation (Apr. 4, 1989–Apr. 6, 1989) discloses a method for stabilizing molten metal level variations to cope with periodic fluctuations of the molten metal level caused by irregular bulging. This method calculates and processes the period and amount of variation of the molten metal level, using a value measured with a vortex flow level gauge. If these lie within a preset range, a correction output is calculated to eliminate fluctuations of the molten metal level. This is then added to the output of the PID controller to suit the molten metal level fluctuation period.

Furthermore, to control the molten metal level, Japanese Published Application 60-144 uses an exciting coil driven by alternating current and a detecting coil to detect the flow velocity, corresponding to the differential of the molten metal level, in the nozzle. This method provides the possibility of coping with changes in the flow within the nozzle caused by clogging of the nozzle and peeling off of the material which clogs the nozzle.

However, since the measurement is a flow velocity measurement, it is difficult to obtain a high measurement accuracy, using the method disclosed by Japanese Published Application 60-144. Also, this method cannot cope with the bulging arising from inside the ingot. In addition, the problem with this method is that expensive apparatuses are required although high-accuracy measurements and a long life of the apparatuses cannot be expected, due to high temperatures causing unfavourable measurement conditions and due to an arrangement of the apparatuses in a limited space.

Furthermore, each of the previously mentioned molten metal level control methods lacks a systematic approach that allows to deal with all of the above-described various disturbances such as clogging of the nozzle caused by deposits, peeling off of these deposits and irregular bulging so that molten metal level fluctuations persist.

The amount of flow of the molten metal is a value which can be directly controlled during molten metal level control. It is a value for the amount of the molten metal accumulated in the mold, that is, it is an integral value which indicates the molten metal level to be established by the control. That is, as this is a system with a large phase delay, it takes some time until the influence of a disturbance produces a result. Therefore, this system is characterized in that control lags behind if feedback control based only on the value of the molten metal level is carried out and that the influence of a disturbance largely subsists. For example, if alumina adhering to the inside of the nozzle suddenly peels off, the flow gain Gc will suddenly increase so that the change of the flow into the mold is a step-shaped curve as shown in FIG. 24(A). If no measures against this are taken, the rise in the molten metal level is described by a ramp-shaped curve as shown in FIG. 24(B). A preferred countermeasure is to operate a flow control actuator such as a stopper, as shown by the step-shaped curve in FIG. 24(C), to eliminate flow fluctuations caused by the disturbance. However, since in a feedback control system, such as a PID control system, countermeasures are taken only after a change in the molten metal level has occurred, the operation of the flow control actuator is slow, as shown in FIG. 24(D). This leads to significant molten metal level fluctuations as shown in FIG. 24(E).

Estimation of flow gain fluctuations and provision of a gain compensation means to correct the feedback control output characterize the molten metal level control device disclosed by Japanese Laid-Open Application 63-192545. However, this device does not operate effectively unless changes in the flow gain, caused for example by a process in which alumina adheres little by little to the inside of the nozzle, occur very slowly. Accordingly, despite the provision of a compensation means, feedback control is still feedback control, the operating principle of which does not provide the possibility of dealing with sudden flow gain fluctuations. Also, as far as disturbances other than flow gain fluctuations, such as irregular bulging, etc. are concerned, this method works in exactly the same manner as a normal PID control system. It therefore offers nothing but control features that are exactly equivalent to those of a normal PID control system.

On the other hand, the molten metal level control method proposed by CAMP-ISIJ-245 provides a means that, apart from the PID control system, computes a correction output. This method measures the molten metal level and calculates the period and amount of variation of the periodic fluctuation caused by irregular bulging. This is then added to the output of the PID controller to suit the molten metal level fluctuation period, thereby attempting to eliminate the fluctuation. However, once the periodic fluctuation of the molten metal level levels off after control is started, a problem of not being able to accurately calculate the ever-changing correction value occurs. The reason for this is that measuring only the level of the molten metal leads to the false observation that the irregular bulging has converged. Also, it goes without saying that this method does not allow to cope with disturbances other than irregular bulging.

Thus, conventional techniques do not provide an effective molten metal level control method for all of the above-described various disturbances so that significant molten metal level fluctuations persist, causing a decline in the ingot quality.

The present invention was carried out to solve these difficulties. It is an object of the present invention to provide a molten metal level control method and device for use in continuous casting, which offer a systematic approach that allows to deal with various disturbances such as nozzles clogged with deposits, peeling off of these deposits and irregular bulging and which are capable of controlling molten metal level fluctuations.

Japanese Laid-Open Application 1-293961 discloses a device which is equipped with a controller used to compute the nozzle opening command in accordance with the deviation of the molten metal level detection signal from the molten metal level target, a mechanism used for adjusting the nozzle opening so that the actual nozzle opening meets the nozzle opening command from the controller, a computing unit which outputs an ideal simulated nozzle opening in accordance with the nozzle opening command from the controller, and a computing unit which compares the actual nozzle opening to the simulated nozzle opening and adds a correction signal, which is the deviation of the actual nozzle opening from the simulated nozzle opening plus a derivative element, to the above-mentioned nozzle opening command.

This device improves the control characteristics of the actuator itself. Its object of control is different from that of the present invention. The model used by the device also differs from that of the present invention. This device therefore does not solve the above-described object.

SUMMARY OF THE INVENTION

The present invention achieves the above-described object as follows. While a continuous casting machine, equipped with an actuator used to control the input flow of molten metal into the mold, continuously casts ingots, flow fluctuations caused by disturbances of the molten metal flowing into or out of the mold are estimated based on at least the measured value of the molten metal level in the mold and the measured value of the position of the flow control actuator or a command value for the position of the flow control actuator from among the group consisting of the measured value of the molten metal level in the mold, the measured value of the position of the flow control actuator or a command value for the position of the flow control actuator, the measured value of the casting speed. Then the amount necessary for operating the flow control actuator to counterbalance the estimated flow fluctuation (disturbance) is determined. Thereafter the flow control actuator is operated on the basis of the determined operating amount. An outline of this is given in FIG. 1.

Furthermore, one method for estimating the flow fluctuations caused by the disturbances is as follows. A process model which describes the variation of the molten metal level and the variation of the disturbances with time is created, with the variation of the molten metal level being determined by the accumulation of the input flow variation plus the flow variation caused by the disturbances in the mold. The input flow variation is in turn determined by the characteristic relation between the position of the flow control actuator and the input flow into the mold and the amount of variation after control of the position of the flow control actuator is started. The measured value of the position of the flow control actuator is input into this process model and the error between the estimated molten metal level and the measured molten metal level, the former being obtained from the process model, is fed back into the process model which then eliminates the difference between the estimate and the measured value. The error between the estimate and the measured value of the molten metal level arising in the computation process is integrated and the flow fluctuation caused by the disturbances is estimated.

Also, another method for estimating the flow fluctuations caused by the disturbances is as follows. A process model which describes the variation of the molten metal level and the variation of the disturbances with time is created, with the variation of the molten metal level being determined by the accumulation of the input flow variation plus the flow variation caused by the disturbances in the mold. The input flow variation is in turn determined by the position command value for the flow control actuator, the characteristic of the control system of the flow control actuator, the characteristic relation between the position of the flow control actuator and the input flow into the mold and the amount of variation after control of the position of the flow control actuator is started. The command value for the position of the flow control actuator is input into this process model and the error between the estimated molten metal level and the measured molten metal level, the former being obtained from the process model, is fed back into the process model which then eliminates the difference between the estimate and the measured value. The error between the estimate and the measured value of the molten metal level arising in the computation process is integrated and the flow fluctuation caused by the disturbances is estimated.

Also, still another method for estimating the flow fluctuations caused by the disturbances is as follows. A process model which describes the variation of the input flow, the variation of the molten metal level and the variation of the disturbances with time is created, whereby the variation of the input flow is determined by the characteristic relation between the position of the flow control actuator and the input flow into the mold and the amount of variation after control of the position of the flow control actuator is started, and the variation of the molten metal level is determined by the accumulation of the difference between the input flow variation and the output flow variation, the latter being determined by the amount of variation after the casting speed control is started, plus the flow variation caused by the disturbances in the mold. The measured value of the position of the flow control actuator and the measured value of the casting speed are input into this process model and the error between the estimated molten metal level and the measured molten metal level, the former being obtained from the process model, is fed back into the process model which then eliminates the difference between the estimate and the measured value. The error between the estimate and the measured value of the molten metal level arising in the computation process is integrated and the flow fluctuation caused by the disturbances is estimated.

Also, still another method for estimating the flow fluctuations caused by the disturbances is as follows. A process model which describes the variation of the input flow, the variation of the molten metal level and the variation of the disturbances with time is created, whereby the variation of the input flow is determined by the position command value for the flow control actuator, the characteristic of the control system of the flow control actuator, the characteristic relation between the position of the flow control actuator and the input flow into the mold and the amount of variation after control of the position of the flow control actuator is started, and the variation of the molten metal level is determined by the accumulation of the difference between the input flow variation and the output flow variation, the latter being determined by the amount of variation after the casting speed control is started, plus the flow variation caused by the disturbances in the mold. The flow control actuator position command value and the measured value of the casting speed are input into this process model and the error between the estimated molten metal level and the measured molten metal level, the former being obtained from the process model, is fed back into the process model which then eliminates the difference between the estimate and measured value. The error between the estimate and the measured value of the molten metal level arising in the computation process is integrated and the flow fluctuation caused by the disturbances is estimated.

Also, still another method for estimating the flow fluctuations caused by the disturbances is as follows. A model for the dynamic behaviour of the actuator, which describes the dynamic behaviour from the position command value for the flow control actuator to the input flow into the mold, is created. The position command value for the flow control actuator is input into the model for the dynamic behaviour of the actuator. The model then estimates the input flow into the mold. Also, the loss of the flow balance in the mold is estimated, as total flow fluctuation, using at least the measured value of the molten metal level from among the group consisting of the measured value of the molten metal level in the mold, the measured value of the position of the actuator and the position command value for the actuator. Then the flow fluctuation caused by the disturbances is estimated, using the difference between the estimated total flow fluctuation and the estimated input flow into the mold.

Also, flow fluctuations caused by disturbances of the molten metal flowing into or out of the mold are estimated. By taking into consideration the operation lag of the flow control actuator, the amount which the actuator must be operated to offset the estimated flow fluctuation is determined. Then the flow control actuator is operated on the basis of this operation amount.

Also, estimation is performed under the assumption that flow fluctuations, caused by disturbances of the molten metal flowing into or out of the mold, can be described by a sine-shaped or a ramp-shaped curve. The amount which the flow control actuator must be operated to offset the estimated flow fluctuation is determined using the estimated flow fluctuation and its derivative. Then the flow control actuator is operated on the basis of this operation amount.

Also, when the flow fluctuation is estimated, the component of the flow fluctuation, caused by disturbances of the molten metal flowing into or out of the mold, which cannot be controlled (suppressed) by the feedback control loop, which acts to eliminate the difference between the measured value and target value of the molten metal level, is estimated using the command value, which the feedback control outputs to the flow control actuator, the measured value of the molten metal level and the model that describes the dynamic behaviour from the position command value of the flow control actuator to the molten metal level in the mold. The actuator command value, used to eliminate the estimated residual amount of the flow fluctuation, is then output, as a correction signal for the command value from the feedback control, to the flow control actuator.

Also, the present invention achieves the above-described object by providing a molten metal level control device for a continuous casting machine that is equipped with an actuator used to control the input flow of molten metal into the mold, whereby the molten metal level control device comprises a molten metal level gauge used to measure the molten metal level in the mold, an actuator position measuring instrument used to measure the position of the flow control actuator, a flow disturbance estimation unit used to estimate flow fluctuations caused by disturbances of the molten metal flowing into or out of the mold using the values measured by the molten metal level gauge and the actuator position measuring instrument, a correction amount computing unit which computes the amount which the flow control actuator must be operated to offset the estimated flow disturbance, and an actuator control system which controls the flow control actuator on the basis of the amount which the flow control actuator must be operated.

Also, the present invention achieves the above-described object by providing a molten metal level control device for a continuous casting machine that is equipped with an actuator used to control the input flow of molten metal into the mold, whereby the molten metal level control device comprises a molten metal level gauge used to measure the molten metal level in the mold, a flow disturbance estimation unit used to estimate flow fluctuations caused by disturbances of the molten metal flowing into or out of the mold using the value measured by the molten metal level gauge and a position command value for the flow control actuator, a correction amount computing unit which computes the amount which the flow control actuator must be operated to offset the estimated flow disturbance, and an actuator control system which controls the flow control actuator on the basis of the amount which the flow control actuator must be operated.

Also, the present invention achieves the above-described object by providing a molten metal level control device for a continuous casting machine that is equipped with an actuator used to control the input flow of molten metal into the mold, whereby the molten metal level control device comprises a molten metal level gauge used to measure the molten metal level in the mold, an actuator position measuring instrument used to measure the position of the flow control actuator, a casting speed meter which measures the casting speed, a flow disturbance estimation unit used to estimate the flow fluctuation caused by disturbances of the molten metal flowing into or out of the mold using the values measured by the molten metal level gauge, the actuator position measuring instrument and the casting speed meter, a correction amount computing unit which computes the amount which the flow control actuator must be operated to offset the estimated flow disturbance, and an actuator control system which controls the flow control actuator on the basis of the amount which the flow control actuator must be operated.

Also, the present invention achieves the above-described object by providing a molten metal level control device for a continuous casting machine that is equipped with an actuator used to control the input flow of molten metal into the mold, whereby the molten metal level control device comprises a molten metal level gauge used to measure the molten metal level in the mold, a casting speed meter which measures the casting speed, a flow disturbance estimation unit used to estimate the flow fluctuation caused by disturbances of the molten metal flowing into or out of the mold using the measured values measured by the molten metal level gauge and the casting speed meter and a position command value for the flow control actuator, a correction amount computing unit which computes the amount which the flow control actuator must be operated to offset the estimated flow disturbance, and an actuator control system which controls the flow control actuator on the basis of the amount which the flow control actuator must be operated.

The inventors devised a molten metal level control method that offers a systematic approach to all sorts of disturbances by using a new method that attributes all of the above-described molten metal fluctuations caused by various disturbances to flow fluctuations caused by disturbances (flow disturbances), then estimates these flow fluctuations and operates a flow control actuator to offset the estimated flow fluctuations.

That is, the amount of variation of the molten metal level is equal to the integrated difference between the flow into the mold and the flow out of the mold. If this difference is zero, there will be no fluctuations of the molten metal level.

Disturbances that cause fluctuations of the input flow include nozzles clogged with deposits, peeling off of these deposits, abrasion of the stopper and play of the flow actuator.

Also, disturbances that cause output flow fluctuations include irregular bulging and casting speed fluctuations.

To estimate such flow fluctuations it may appear that, since the integral of the difference between the input and output flow represents the molten metal level fluctuations, it suffices to measure the molten metal level and perform differentiation of the measured value. However, actually it is impossible to obtain a good estimate value by differentiation of the measured value which is superimposed by measurement noise. Furthermore, the molten metal level control system that merely observing the output of the system involves similar problems that internal quantities of the system cannot be estimated, as the above-described system proposed by CAMP-ISIJ-245.

The present invention therefore estimates disturbances causing flow fluctuations on the basis of at least the measured value of the molten metal level and the measured value of the position or the position command value of a flow control actuator such as a stopper or a sliding nozzle. Taking into consideration the measured value of the position or the position command value of the flow control actuator when estimating disturbances allows disturbances to be accurately estimated even after the molten metal level has levelled off due to the control.

Then, the amount which the flow control actuator must be operated to offset the estimated flow fluctuations is determined using the estimated flow fluctuations and, on the basis of this amount, the flow control actuator (e.g. a stopper or a sliding nozzle) is operated in a feed-forward fashion, thereby providing quick measures to offset flow fluctuations caused by disturbances and suppress molten metal fluctuations.

Since the present invention offers a systematic approach to a variety of disturbances of different nature such as nozzles clogged with deposits, peeling off of these deposits, irregular bulging, play of the flow control actuator, etc. by systematically treating these disturbances as flow fluctuations, which are caused by these disturbances, all sorts of disturbances can quickly be dealt with, thus allowing the molten metal level to always be kept stable. This in turn results in good-quality ingots and improvement in the ingot yield rate.

Moreover, the inventors devised a molten metal level control method that offers a stable and good controllability of molten metal level to all sorts of disturbances by using a new method that attributes all of the above-described molten metal fluctuations caused by various disturbances to changes in the position command value for the flow control actuator and applies a correction signal to the flow control actuator to eliminate the command quantity corresponding to the flow disturbance.

This corresponds to the molten metal control method which estimates flow fluctuations caused by disturbances of the molten metal flowing into or out of the mold, determines the amount which the flow control actuator must be operated to offset the estimated flow fluctuations by taking into consideration the operation lag of the flow control actuator and operates the flow control actuator on the basis of this operation amount.

In the present invention, the actual command value for the position of a flow control actuator such as a stopper or a sliding nozzle is input into a model to determine the command amount corresponding to the disturbance, which corresponds to the difference between the actual detected molten metal level and the predicted molten metal level, the latter being output from the model.

Then, a correction signal is applied to the flow control actuator to eliminate the command quantity corresponding to the disturbance and the flow control actuator (e.g. a stopper or a sliding nozzle) is operated, using feed-forward control, to offset molten metal flow fluctuations caused by disturbances.

Since the present invention thus offers a systematic approach to a variety of disturbances of different nature such as nozzles clogged with deposits, peeling off of these deposits, irregular bulging, etc. by systematically treating these disturbances as molten metal level fluctuations, which are caused by these disturbances, and since the dynamic behaviour (operation lag) of the flow control actuator is also taken into consideration, all sorts of disturbances can quickly and appropriately be dealt with, thus allowing the molten metal level to always be kept stable. This in turn results in good-quality ingots, prevents the occurrence of defects and improves the ingot yield rate.

Furthermore, the present invention also provides a method for making estimations under the assumption that flow fluctuations caused by disturbances are represented by ramp-shaped or sine-shaped curves.

According to this method, the amount of disturbance caused by nozzles clogged with deposits, peeling off of these deposits, irregular bulging, etc. is estimated by assuming that it is a flow fluctuation (disturbance), which is represented by a ramp-shaped or sine-shaped curve. Then a correction signal used to eliminate the disturbance amount, is computed using the flow disturbance estimate and its derivative.

This correction signal for the feedback operation signal generated by the feedback control loop is then applied to the actuator, which controls the input flow into the mold, to eliminate molten metal level fluctuations caused by disturbances such as irregular bulging.

Furthermore, the present invention also provides a method for estimating the component of the flow fluctuation, caused by disturbances of the molten metal flowing into or out of the mold, which cannot be controlled (suppressed) by the feedback control loop, which acts to eliminate the difference between the measured value and target value of the molten metal level when the flow fluctuation is estimated, as residual flow fluctuation amount, using the command value, which the feedback control outputs to the flow control actuator, the measured value of the molten metal level and the process model for molten metal level system.

According to this method, the feedback control loop acts to eliminate the difference between the actual value and the target value of the molten metal level.

Then, the residual amount of the disturbance, which cannot be controlled by the feedback control, is estimated using the command value, which the residual disturbance elimination control loop outputs to the flow control actuator, the actual value of the molten metal level and the molten metal level control model. On the basis of this estimate, the actuator command value used to eliminate the residual amount is computed and output to the actuator as a correction signal.

Thus, disturbances caused by nozzles clogged with deposits, peeling off of these deposits, irregular bulging, etc. are controlled by a feedback control loop and the residual amount of the disturbance, which cannot be controlled by the feedback control, is eliminated by the correction signal from the residual disturbance elimination control loop so that the molten metal level will not be affected by disturbances and can always be kept stable.

BRIEF DESCRIPTION OF THE DRAWINGS

FIG. 7(B) shows the response of a conventional example as compared to the present invention.

DESCRIPTION OF THE PREFERRED EMBODIMENTS

The embodiments of the present invention will be described in detail hereinunder with reference to the drawings.

Figure 1:
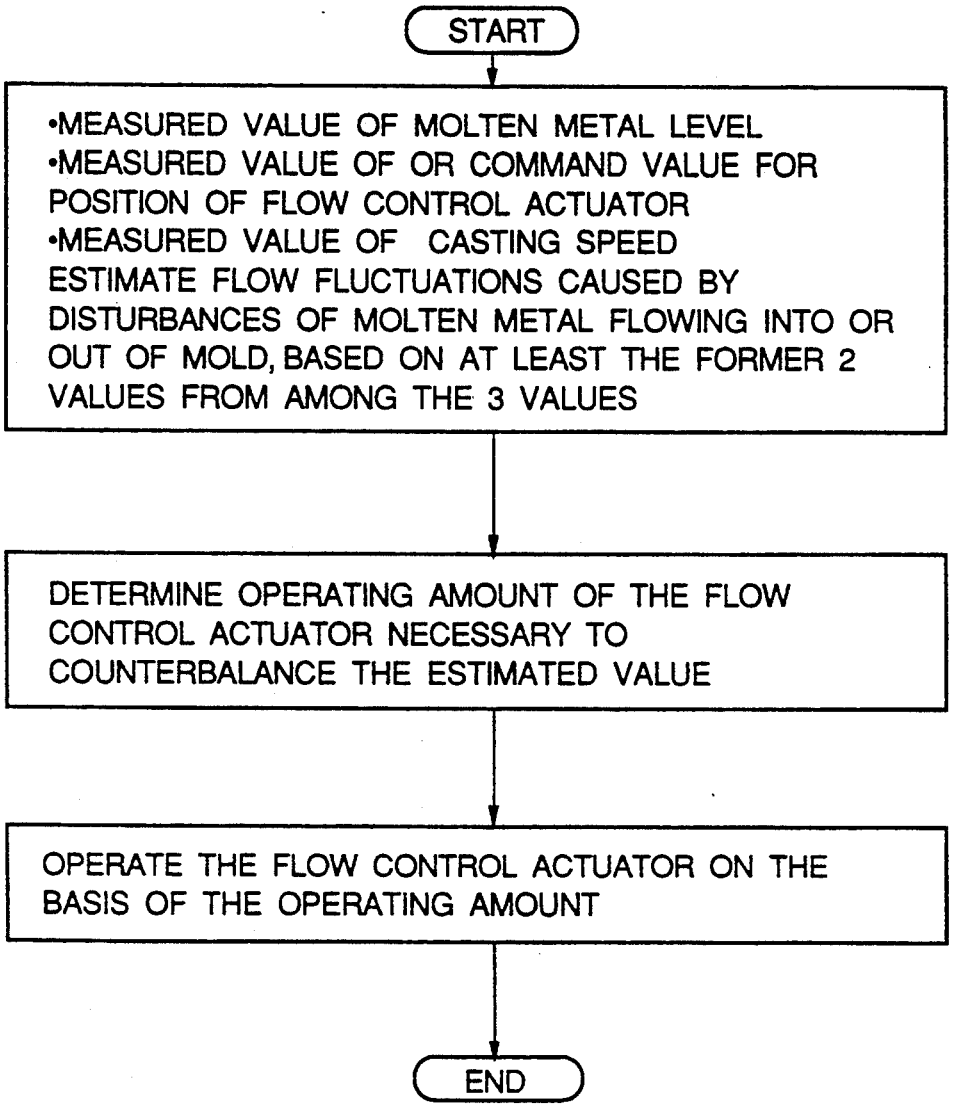
FIG. 1 is a flow chart showing the outline of the molten metal level control method for the continuous casting of the present invention, FIG. 2 (A) is a block diagram showing the configuration of an embodiment of the molten metal level control system according to the present invention, FIG. 2 (B) gives an outline of the configuration of the flow fluctuation estimation instrument.
Figure 2A:
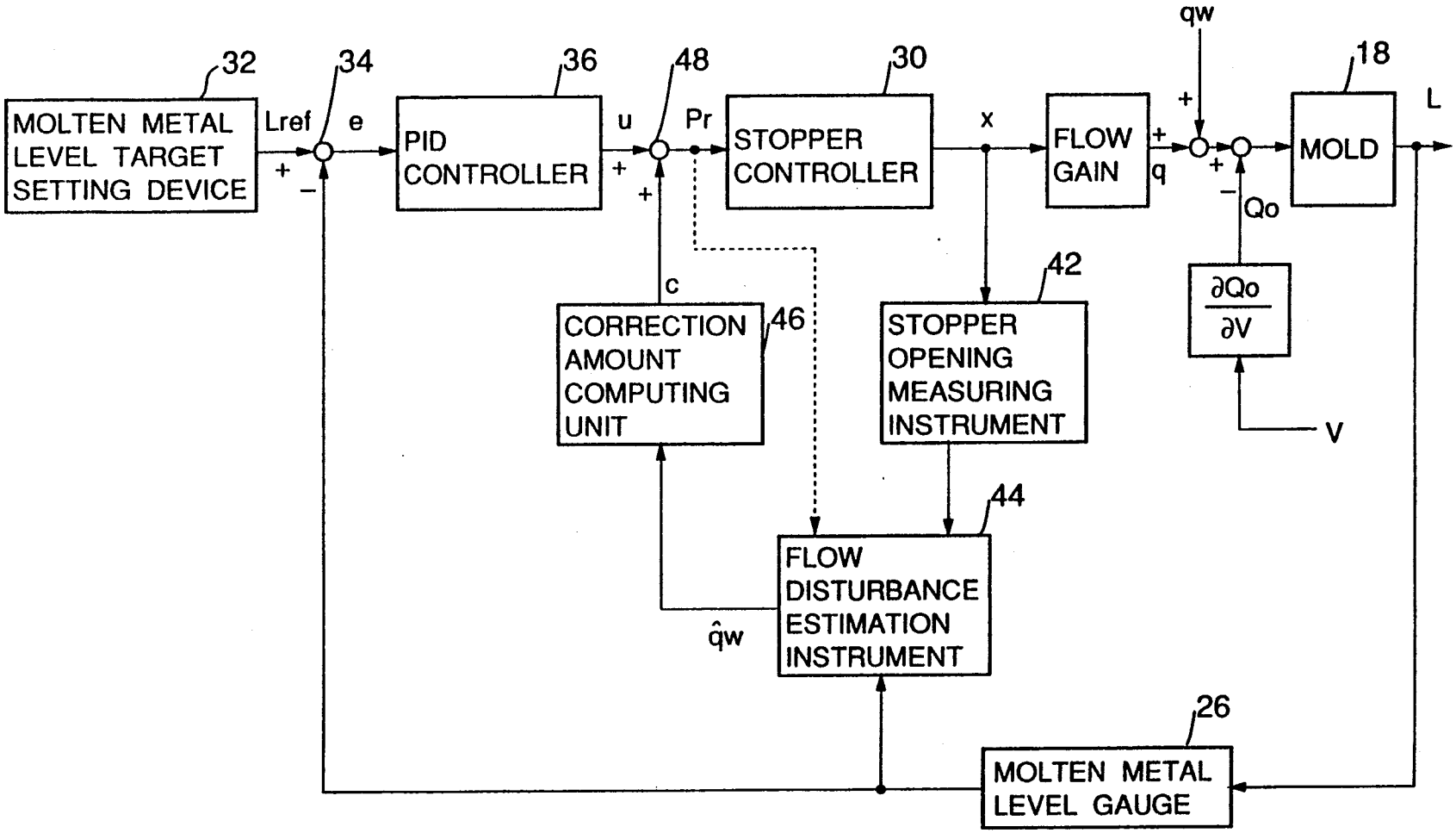
Figure 23:
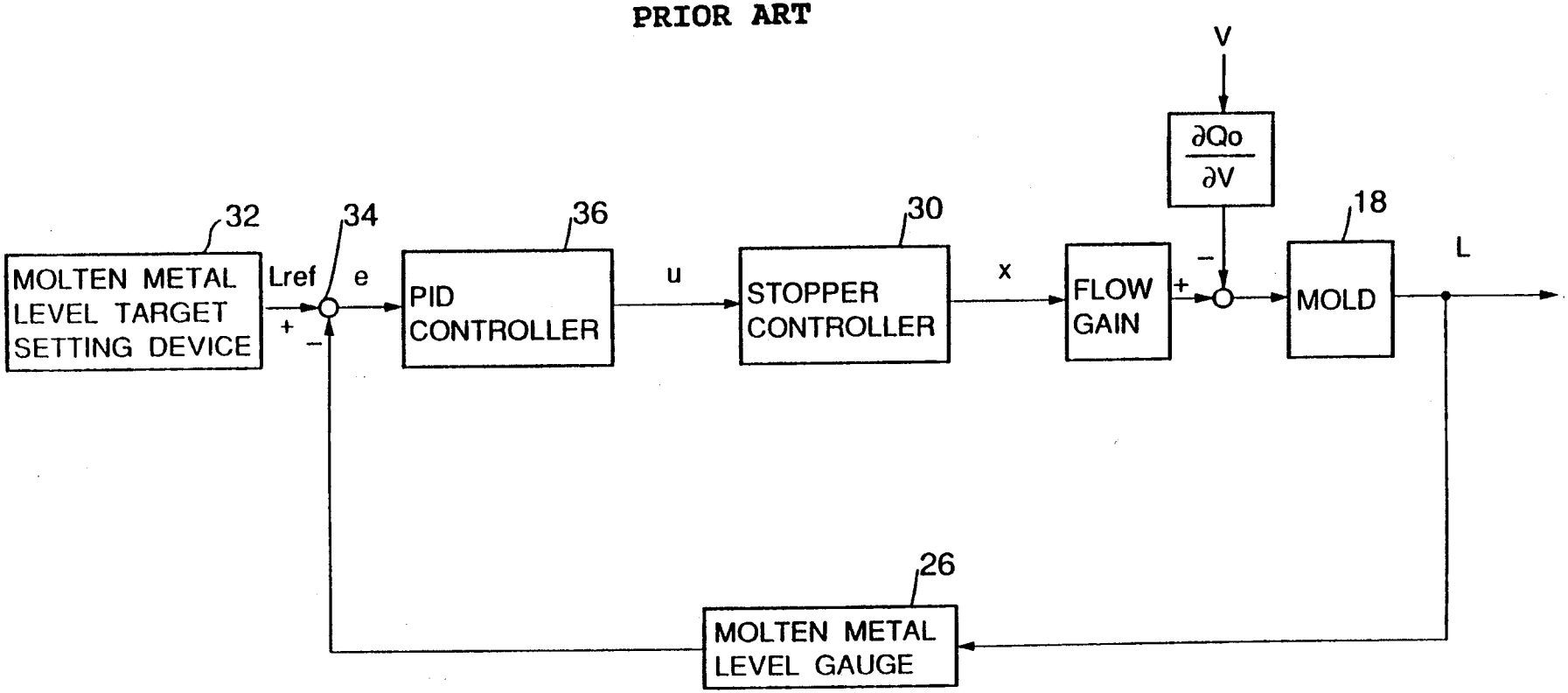
FIG.23 PRIOR ART
FIG. 23 is a block diagram using transfer functions to show the device of FIG. 22, and FIG. 24(A) to (E) are diagrams showing an example of molten metal level fluctuations in the event that deposits inside the nozzle peel off.
Figure 24A:
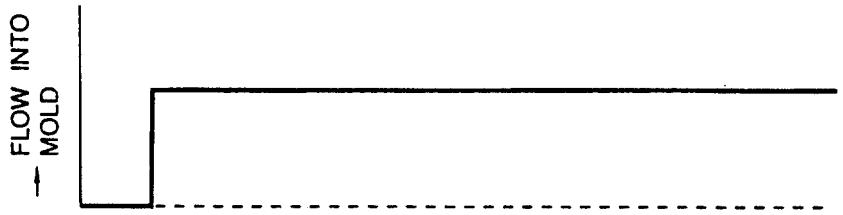
Figure 24B:
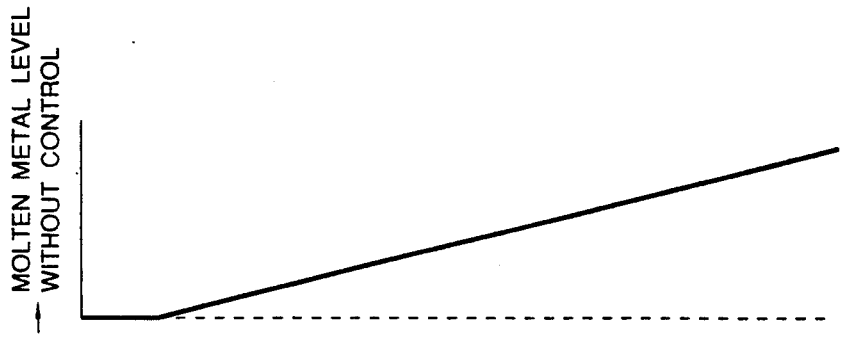
Figure 24C:
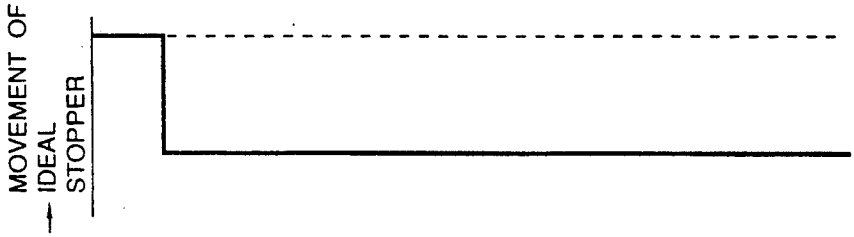
Figure 24D:
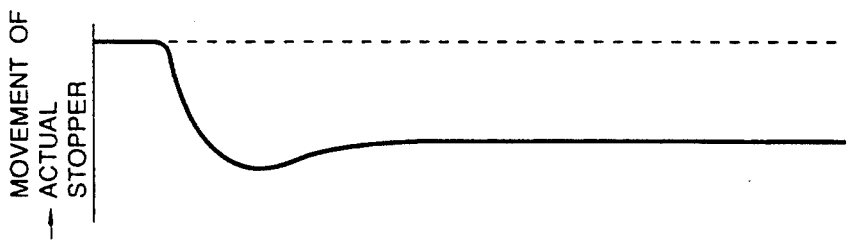
Figure 24E:
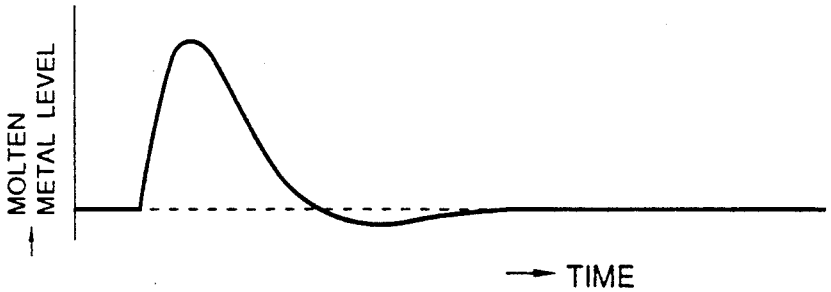

The first embodiment of a molten metal level control device used to implement the molten metal level control method according to the present invention is a molten metal level control device comprising, as indicated by the solid lines in FIG. 2(A), the same molten metal level target setting device 32, comparator 34, PID controller 36, stopper controller 30, flow gain Gc, mold 18 and molten metal level gauge 26 as a conventional molten metal level control device (FIG. 23). In addition, the molten metal level control device according to the present invention is equipped with a stopper degree measuring instrument 42 used to measure the actual opening (position) x of the stopper 28, a flow disturbance estimation instrument 44 used to estimate the flow fluctuation qw, caused by disturbances, of the molten steel flowing into or out of the mold 18 with the estimation being based on the outputs L and x of the molten metal level gauge 26 and the stopper pening measuring instrument 42, respectively, a correction amount computing unit 46 used for computing the stopper position change c to provide the mold 18 with a flow change necessary to offset the flow disturbance estimate $\hat{qw}$, which is output from the flow disturbance estimation instrument 44, and an adder 48 which adds the output c from the correction amount computing unit 46 to the output u from the PID controller 36 and inputs the sum as command value Pr into the stopper controller 30.

Figure 2B:
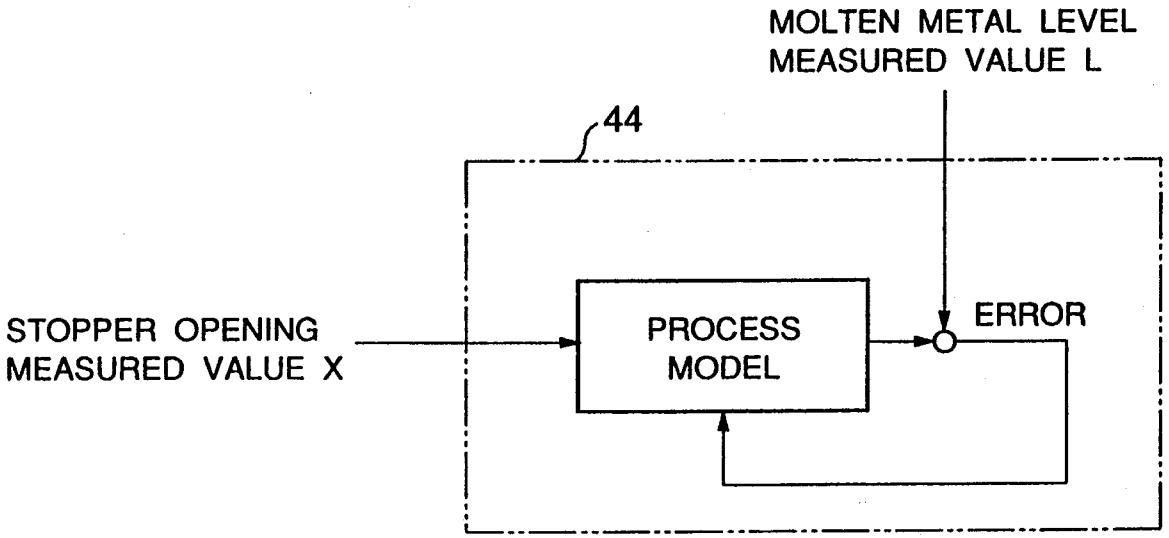

As shown in FIG. 2 (B), the flow disturbance estimation instrument 44 has a process model which describes the variation of the molten metal level fluctuation and the disturbance with time, the former being determined by the accumulation of the input flow fluctuation plus the flow fluctuation caused by the disturbance in the mold. The input flow fluctuation in turn is determined by the characteristic relation between the stopper opening and the mold input flow and the amount of fluctuation after starting the control of the stopper opening. The measured value of the stopper opening is entered into the process model. The error between the estimated molten metal level and the measured molten metal level, the former being obtained from the process model, is fed back into the process model which eliminates the difference between the estimate and the measured value. The error between the estimated and the measured molten metal level arising in the computation process is integrated and the flow fluctuations caused by the disturbance is estimated.

In the following, the function of the first embodiment will be described.

The molten metal level L measured by the molten metal level gauge 26 and the stopper opening x measured by the stopper opening measuring instrument 42 are input into the flow disturbance estimation instrument 44.

The flow disturbance estimation instrument 44 computes the flow disturbance estimate $\widehat{qw}$, on the basis of the measured value L of the molten metal level and the measured value x of the stopper opening and inputs $\widehat{qw}$, into the correction amount computing unit 46.

For example, the flow disturbance estimation instrument 44 estimates the flow disturbance as follows: A process model which describes how the molten metal level L and the flow fluctuation qw vary with time is created. The molten metal level fluctuation is determined by the accumulation of the input flow q plus the flow fluctuation qw caused by the disturbance in the mold 18. The input flow q in turn is determined by the position of the stopper 28 and the flow gain. The measured value x of the stopper position is entered into the process model. The error between the estimated molten metal level and the measured molten metal level, the former being obtained from the process model, is fed back into the process model which eliminates the difference between the estimate and the measured value (gradual reduction of the error to zero). The error between the estimated and measured molten metal level arising in the computation process is integrated and the flow fluctuations qw caused by the disturbance is estimated.

In the above description, the input flow q and the molten metal level L are actually expressions for the amount of variation of the input flow and the molten metal level which occurs after the molten metal level control according to the present invention is started. q and L should therefore be called amount of variation of the input flow and amount of variation of the molten metal level, respectively. However, for simplicity and convenience, the wording amount of variation is not used to express q and L. Accordingly, at the time of starting the molten metal level control according to the present invention q=0 and L=0. The time when the molten metal level control according to the present invention is started also serves as reference point of time for the flow fluctuation qw caused by the disturbance so that qw=0 at that time. In the following description, all variables are expressions for variations that occur after the molten metal level control according to the present invention is started.

Based on the flow disturbance estimate $\widehat{qw}$, calculated by the flow disturbance estimation instrument 44, the correction amount computing unit 46 computes the stopper position change c necessary to offset the flow disturbance estimate $\widehat{qw}$. More specifically, multiplying the flow disturbance estimate $\widehat{qw}$, by the gain G' gives the correction amount c, as shown in the following formula:

$$c=G'\cdot\widehat{qw} \tag{2}$$

If the gain G' is taken to be the inverse of Gc (the flow gain in FIG. 2(A)), which describes the characteristic relation between the input flow and the stopper opening, that is if $$G'=-1/Gc \tag{3}$$

then the flow disturbance qw at the inlet of the mold 18 becomes $$qw-(1/Gc)\cdot\widehat{qw}\cdot G\approx 0 \tag{4}$$

so that the flow disturbance qw can be offset.

The adder 48 adds the output c from the correction amount computing unit 46 to the output u from the PID controller 36 and sends the sum Pr (Pr=u+c), as stopper position command value, to the stopper controller 30.

Based on the stopper position command value Pr, the stopper controller 30 controls the position x of the stopper 28 to adjust the input flow q into the mold 18. As a result, the molten metal level L in the mold 18 is maintained at a constant level despite the additional flow disturbance qw. Although the sum of the output u from the PID controller 36 and the output c from the correction amount computing unit 46 is entered into the stopper controller 30, the correction amount c actually governs the action, whereas the output u from the PID controller 36 is used for the compensation of the estimation error and the modification of the molten metal level target value Lref.

In the following, the second embodiment according to the present invention will be described.

The molten level control device of the second embodiment is the same as that of the first embodiment. However, the stopper opening measuring instrument 42 is omitted. As indicated by the broken line in FIG. 2(A), the flow fluctuation qw is estimated using the position command value Pr for the stopper controller 30.

The flow fluctuation qw caused by disturbances is estimated as follows in the second embodiment: A process model which describes how the position command value Pr for the stopper 28, the molten metal level L and the flow fluctuation qw vary with time is created. The molten metal level L is determined by the accumulation of the input flow q plus the flow fluctuation qw caused by the disturbance in the mold 18. The input flow q in turn is determined by the characteristic of the stopper controller 30, the characteristic relation between the position of the stopper 28 and the mold input flow and the position of the stopper. The stopper position command value Pr is entered into the process model. The error between the estimated molten metal level and the measured molten metal level, the former being obtained from the process model, is fed back into the process model which eliminates the difference between the estimate and the measured value. The error between the estimated and measured molten metal level arising in the computation process is integrated and the flow fluctuations caused by the disturbance is estimated.

In the following, mathematical expressions are used to give a detailed description of the flow disturbance estimation method employed by the second embodiment.

Figure 3:
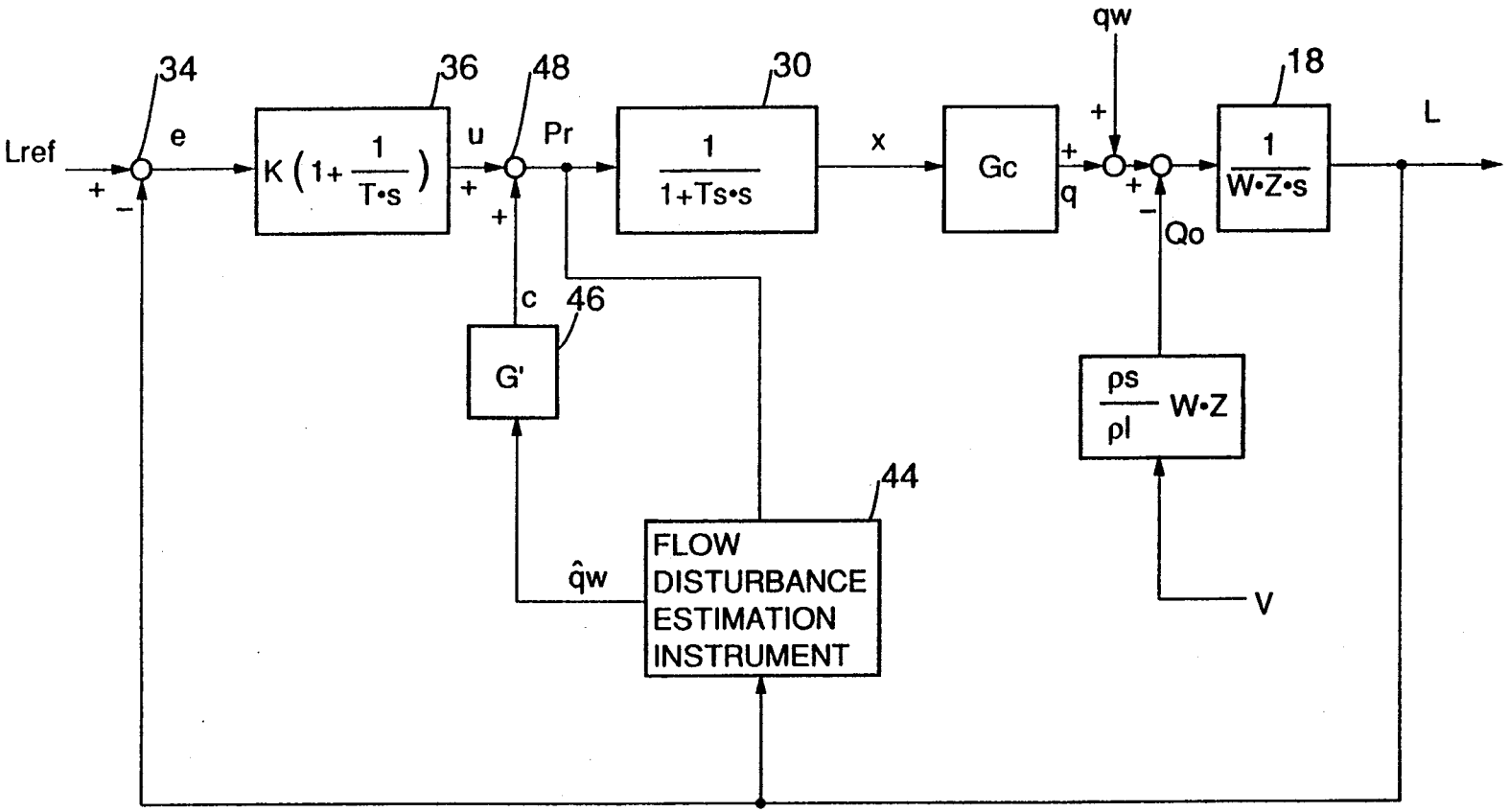
FIG. 3 is a block diagram showing the molten metal level control system using transfer functions to explain the method employed by the flow disturbance estimation instrument to estimate flow disturbances.

FIG. 3 uses transfer functions to represent the molten metal level control system shown in FIG. 2(A). The mold width and thickness are assumed to be W and Z, respectively, and the characteristic of the mold 18 is represented by $1/W \cdot Z \cdot s$, where s is the Laplace operator. Also, the characteristic relation between the stopper opening x and the input flow q can be set as the flow gain Gc (constant number) if the flow is approximated to be proportional to the opening. In addition, the stopper controller 30 can be approximated by $1/(1+Ts \cdot s)$, with the time constant Ts being a time lag of first order. Furthermore, the characteristic of the molten metal level gauge 26 is approximated by 1 so that the molten metal level L can be measured directly. The characteristic of the PID controller 36 is represented by $K \cdot (1+1/T \cdot s)$, where K is the proportional gain, T is the integral time and the derivative gain is equal to zero (explained for the case of the PI control).

Under the above assumptions, the relation between the stopper position command value Pr, the stopper position x, the molten steel flow q into the mold 18, the flow disturbance qw and the molten steel level L is described by the following formulas:

$$x=\{1/(1+T_s \cdot s)\} \cdot Pr \tag{5}$$

$$q=G_c \cdot x \tag{6}$$

$$L=\{1/(W \cdot Z \cdot s)\} \cdot (q+qw) \tag{7}$$

As the variation $\dot{q}w$ of the flow disturbance qw with time cannot be predicted beforehand, for the time being it is assumed to be zero. In symbols, $$\dot{q}w=0 \tag{8}$$

Then the formulas (5)–(8) can be combined and expressed as follows:

$$\begin{pmatrix} \dot{L} \\ \dot{q} \\ \dot{q}w \end{pmatrix} = \begin{pmatrix} 0 & 1/W \cdot Z & 1/W \cdot Z \\ 0 & -1/Ts & 0 \\ 0 & 0 & 0 \end{pmatrix} \times \begin{pmatrix} L \\ q \\ qw \end{pmatrix} + \begin{pmatrix} 0 \\ G_c/T_s \\ 0 \end{pmatrix} \times Pr \tag{9}$$

where the dot · on top of L and the like indicate the derivative with respect to time.

Formula (9) is a model which describes how the molten metal level L, the molten steel flow q into the mold 18 and the flow disturbance qw vary with time.

If the values estimated by the flow disturbance estimation instrument 44 for the molten metal level L, the molten metal flow q into the mold 18 and the flow disturbance qw are assumed to be $\hat{L}$, $\hat{q}$, $\hat{qw}$, respectively, then feedback of the molten metal level estimation error into formula (9) yields the following formula for each estimate:

$$\begin{pmatrix} \dot{\hat{L}} \\ \dot{\hat{q}} \\ \dot{\hat{qw}} \end{pmatrix} = \begin{pmatrix} 0 & 1/W \cdot Z & 1/W \cdot Z \\ 0 & -1/T_s & 0 \\ 0 & 0 & 0 \end{pmatrix} \times \begin{pmatrix} L \\ q \\ qw \end{pmatrix} + \begin{pmatrix} 0 \\ G_c/T_s \\ 0 \end{pmatrix} \times Pr + \begin{pmatrix} g1 \\ g2 \\ g3 \end{pmatrix} \times (L - \hat{L}) \tag{10}$$

where g1, g2 and g3 are feedback gains used to gradually reduce the error $\hat{L}-L$ between the molten metal level $\hat{L}$ and the estimated molten metal level $\hat{L}$ to zero by feeding the error $\hat{L}-L$ back.

Rewriting equation (10) gives the following formula:

$$\begin{pmatrix} \dot{\hat{L}} \\ \dot{\hat{q}} \\ \dot{\hat{qw}} \end{pmatrix} = \begin{pmatrix} -g1 & 1/W \cdot Z & 1/W \cdot Z \\ -g2 & -1/T_s & 0 \\ -g3 & 0 & 0 \end{pmatrix} \times \begin{pmatrix} \hat{L} \\ \hat{q} \\ \hat{qw} \end{pmatrix} + \begin{pmatrix} g1 & 0 \\ g2 & G_c/T_s \\ g3 & 0 \end{pmatrix} \times \begin{pmatrix} L \\ Pr \end{pmatrix} \tag{11}$$

Expression (11) is a differential equation for the estimate $\hat{L}$ of the molten metal level, the estimate $\hat{q}$ of the input flow and the estimate $\hat{qw}$ of the flow disturbance, with the known quantities being the molten metal level L and the stopper position command value Pr. $\hat{L}$, $\hat{q}$, $\hat{qw}$ can be determined by solving this differential equation.

The following explanation refers to the estimate $\hat{qw}$ of the flow disturbance. From equation (11), $$\dot{\hat{qw}}=g3 \cdot (L-\hat{L}) \tag{12}$$

and thus $$\hat{qw}=\int g3 \cdot (L-\hat{L})\, dt \tag{13}$$

Therefore, integration of the estimation error $\hat{L}-L$ of the molten metal level with respect to time allows to determine the estimate $\hat{qw}$ of the flow disturbance. Since g1, g2 and g3 are parameters which determine the characteristic of the flow disturbance estimation instrument 44 with a configration as described above, they can be appropriately selected provided that careful consideration is given to the characteristic of the overall molten metal injection system.

If, in the same manner as in the second embodiment, the stopper position command value Pr is used to determine the estimate $\hat{qw}$ of the folw disturbance, then the stopper opening measuring instrument 42 can be omitted. This is therefore ideal for cases in which a stopper opening measuring instrument 42 is difficult to install, due to structural and maintenance problems.

In the above description, the characteristic of he molten metal level gauge 26 is approximated by 1. However, if the flow disturbance estimation instrument 44 is built with the characteristic of the molten metal level gaue 26 being represented by a time lag of first order, then the time lag can be taken into consideration.

Figure 4A:
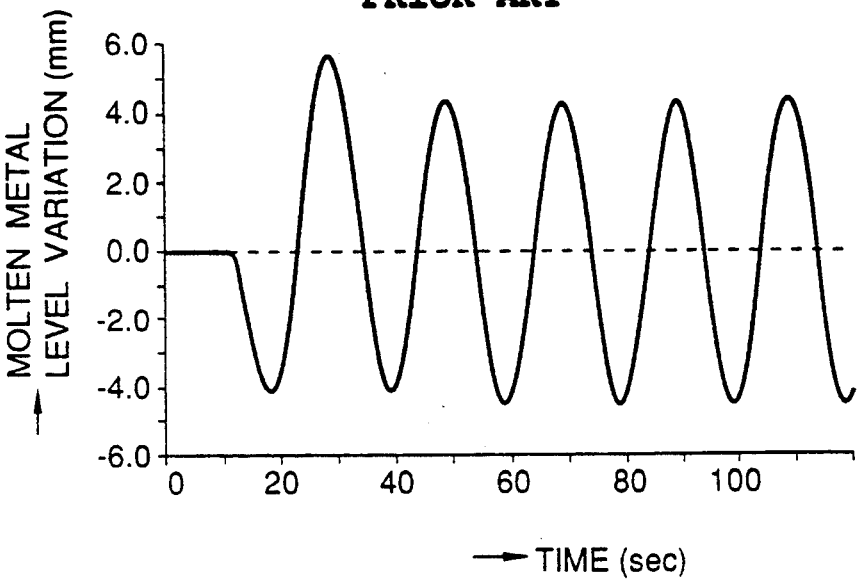
FIG.4(A) PRIOR ART
FIG. 4(A) is a diagram showing the result of a numerical experiment in which the control performance is of conventional PI control.
Figure 4B:
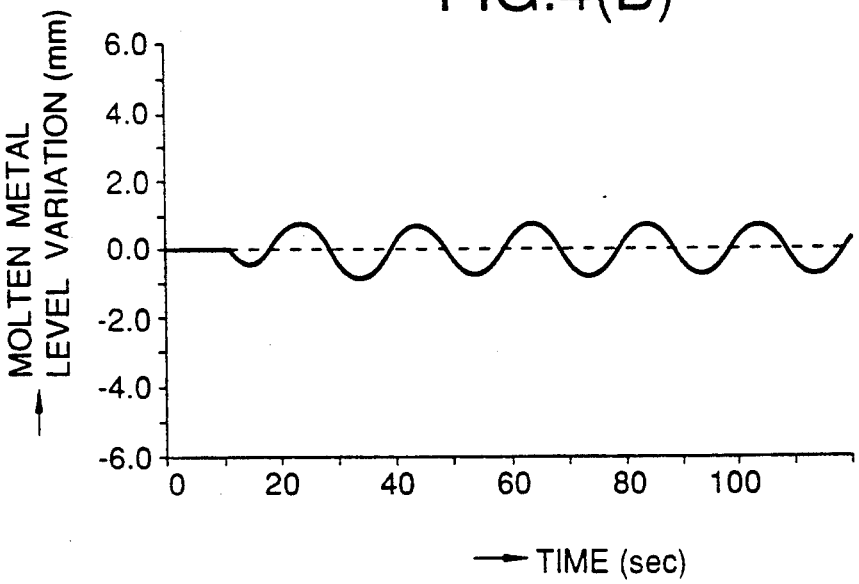
FIG. 4(B) is a diagram showing the control method according to the present invention with regard to irregular bulging are compared.

FIG. 4 shows the result of a numerical experiment in which the control performance of conventional PI control (FIG. 4(A)) and the control according to the present invention (FIG. 4(B)) are analysed for the case when irregular bulging causes a sine-shaped fluctuation of the flow out of the mold. The amplitude of the fluctuation is set to 10 percent of the steady-state flow and the period is set to 20 seconds. For the PI control shown in FIG. 4 (A), control is delayed since the stopper position is changed after a fluctuation of the molten metal level has occurred. As a result, the range of variation of the molten metal level is −4.57 to +5.65 mm so that the total variation amounts to 10.22 mm. Contrary to this, the control according to the present invention allows steps to be quickly taken since disturbances can be directly captured in the form of flow fluctuations before the disturbances appear as molten metal level fluctuations. As shown in FIG. 4 (B), the range of variation of the molten metal level is −0.86 to +0.86 mm so that total variation is 1.72 mm. This means that the range of variation is cut down to 16.8 percent of the range of variation of the conventional PI control.

Figure 5A:
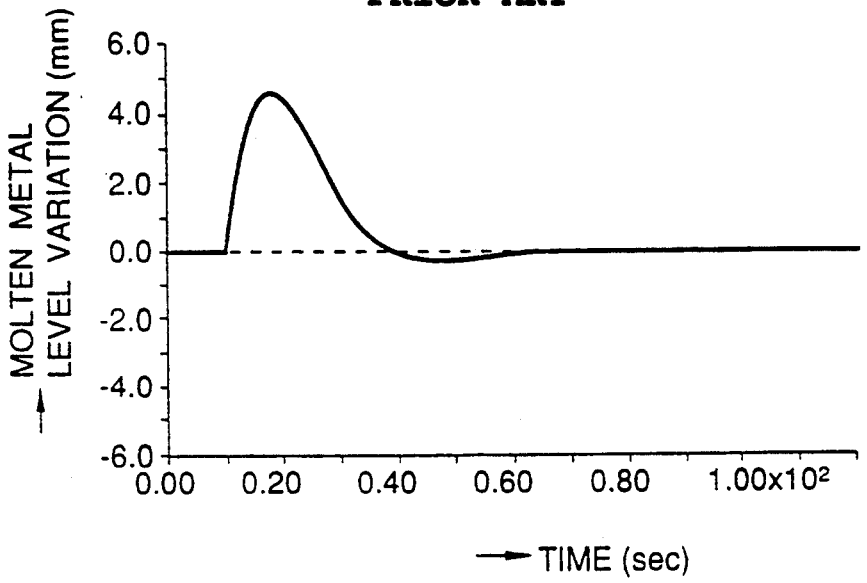
FIG.5(A) PRIOR ART
FIG. 5(A) is a diagram showing the result of a numerical experiment in which the control performance is of conventional PI control.
Figure 5B:
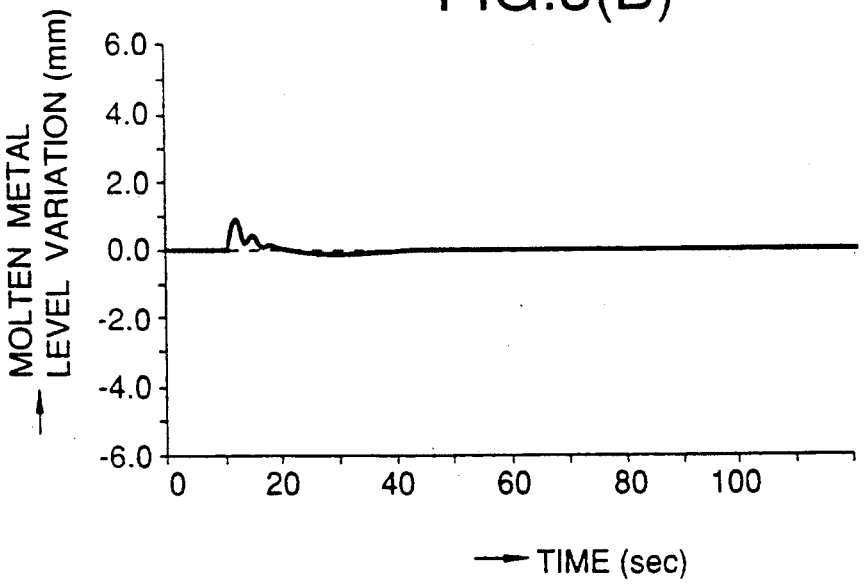
FIG. 5(B) is a diagram showing the control method according to the present invention are compared, assuming the event that deposits in the nozzle peeled off.

FIG. 5 shows the result of a numerical experiment in which the control performance of conventional PI control (FIG. 5 (A)) is compared to the control method according to the present invention (FIG. 5 (B)) for the case when the input flow from the stopper is increased by step in 10 percent increment. This is a simulation of the case in which alumina adhering to the nozzle suddenly peels off. As shown in FIG. 5 (A), for PI control the range of variation of the molten metal level is −0.29 to +4.68 mm so that the total variation amounts to 4.97 mm. Contrary to this, as shown in FIG. 5 (B), for the control according to the present invention the range of variation of the molten metal level is −0.17 to +0.90 mm so that total variation is 1.07 mm. This means that the range of variation is cut down to 21.5 percent of the range of variation of the conventional PI control.

Figure 6:
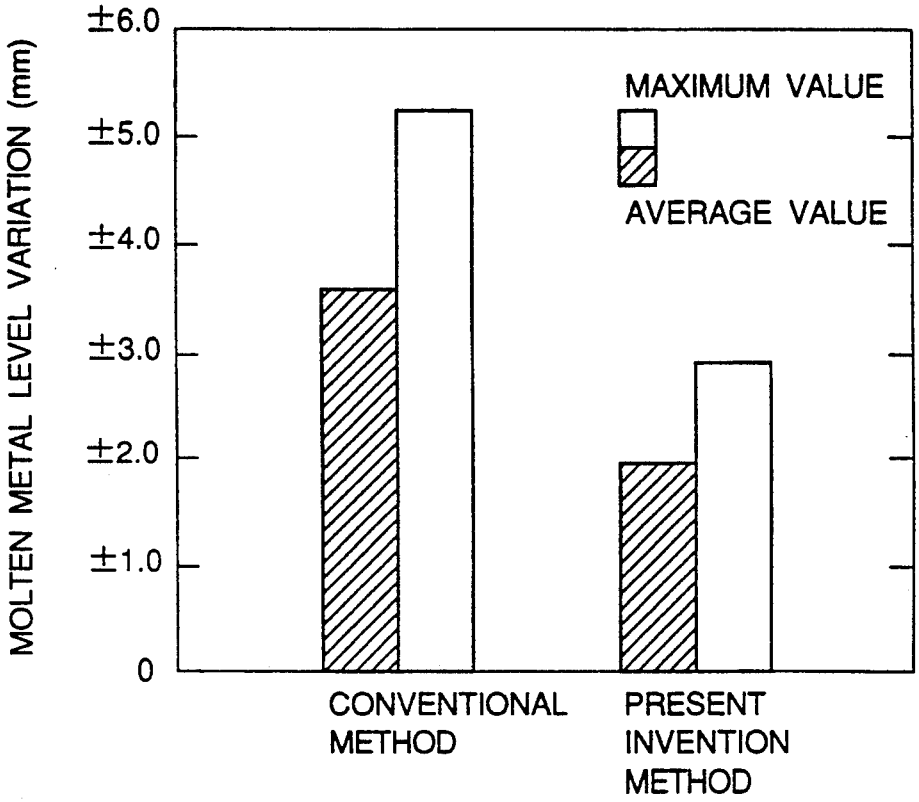
FIG. 6 is a diagram showing a comparison between a conventional method and the results obtained when the present invention is actually applied to irregular bulging.
Figure 7:
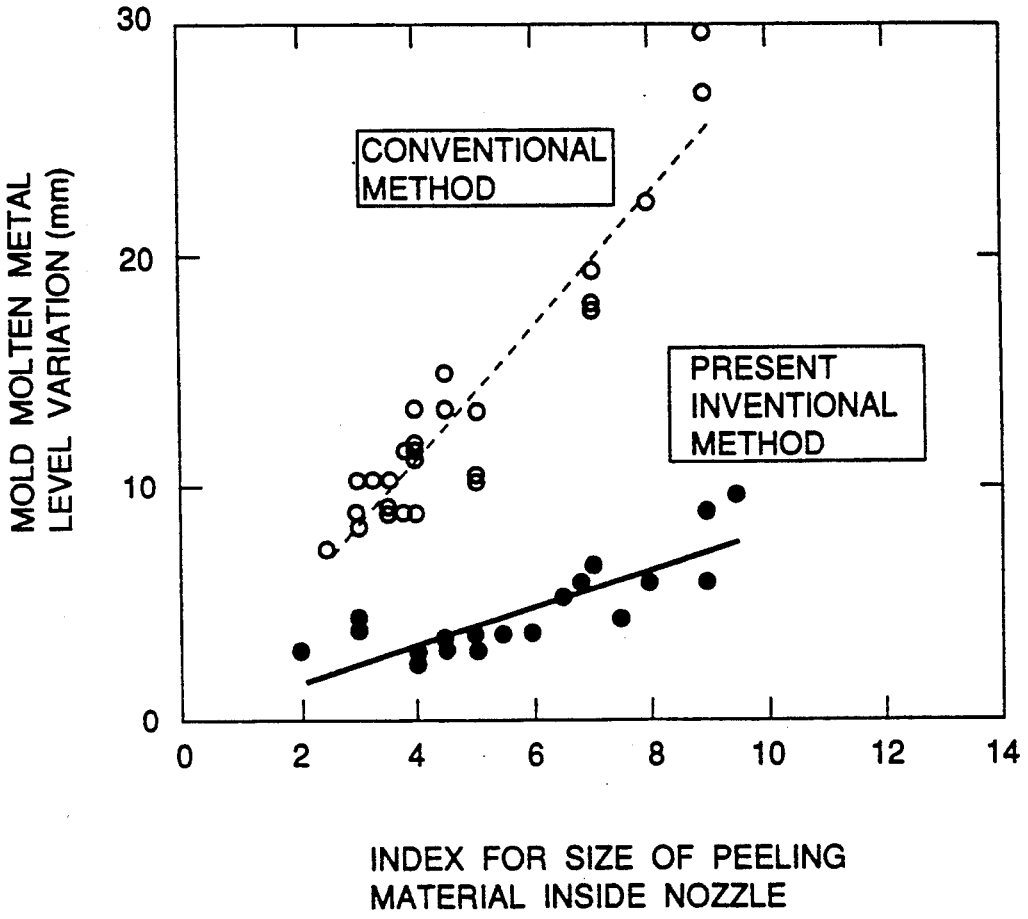
FIG. 7 is a diagram showing a comparison between a conventional method and the results obtained when the present invention is actually applied to the peeling off of deposits inside the nozzle.

Furthermore, actual application of the present invention has yielded the results shown in FIG. 6 for molten metal level fluctuations caused by irregular bulging and FIG. 7 for molten metal level fluctuations caused by peeling off of deposits inside the nozzle. "Index for size of peeling material inside nozzle" in FIG. 7 corresponds to the change (mm) of the stopper opening.

In the following, the third embodiment according to the present invention will be described in detail.

To meet various operation requirements, continuous casting generally requires that the casting speed be changed during operation, which also causes flow disturbances. Since the present invention provides a method for dealing systematically with all kind of disturbances, it also allows to cope with changes in the casting speed without any need for special information on casting speed changes. However, as the casting speed is a quantity which is artificially manipulated, flow disturbances caused by casting speed changes can be definitely predetermined. Therefore, flow disturbances caused by casting speed changes normally allow fluctuations of the molten metal level L to be controlled by feed-forward control of the casting speed.

Figure 8:
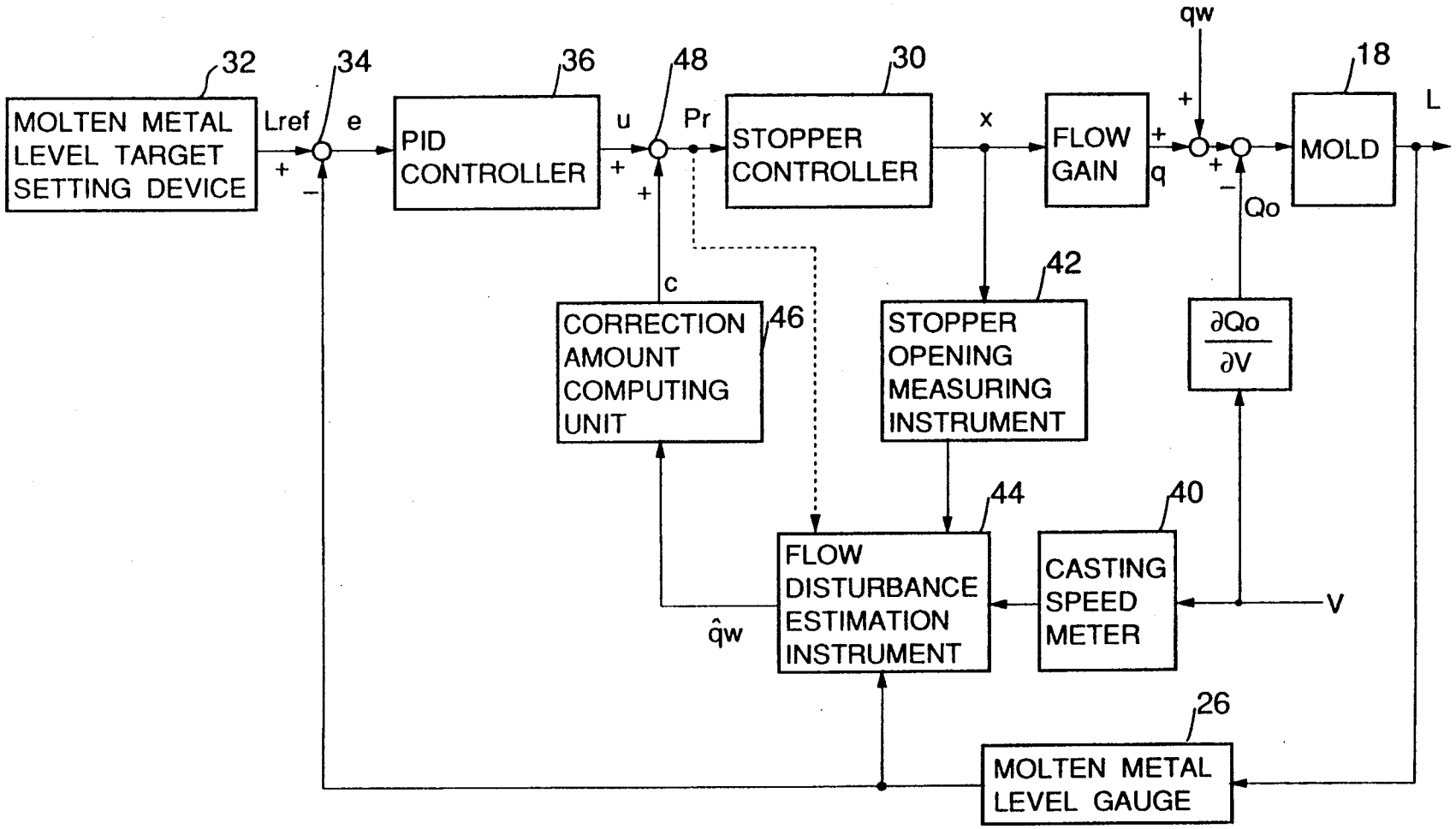
FIG. 8 is a block diagram showing the configuration of another embodiment of the molten metal level control system according to the present invention.

The third embodiment is an example in which feed-forward control of the casting speed is used at the same time. The configuration of the third embodiment is shown with solid lines in FIG. 8. FIG. 8 corresponds to FIG. 2 (A).

In the configuration of the third embodiment, an additional casting speed meter 40 used to measure the casting speed V is incorporated into the molten metal level control device of the first embodiment. That is, in addition to the molten metal level target setting device 32, the comparator 34, the PID controller 36, the stopper controller 30, the flow gain Gc, the mold 18 and the molten metal level gauge 26, the molten metal level control device comprises a casting speed meter 40, a stopper opening measuring instrument 42 used to measure the actual opening x of the stopper 28, a flow disturbance estimation instrument 44 used to estimate the flow fluctuation qw caused by disturbances of molten steel flowing into or out of the mold 18, with the estimation being based on the outputs L, x and V from the molten metal level gauge 26, the stopper opening measuring instrument 42 and the casting speed meter 40, respectively, a correction amount computing unit 46 used for computing the stopper position change c to provide the mold 18 with a flow change necessary to offset the flow disturbance estimate $\widehat{qw}$ which is output from the flow disturbance estimation instrument 44, and an adder 48 which adds the output c from the correction amount computing unit 46 to the output u from the PID controller 36 and inputs the sum, the command value Pr, into the stopper controller 30.

In the following, the function of the third embodiment will be described.

The casting speed meter 40 measures the casting speed V and outputs the measured value V to the flow disturbance estimation instrument 44. The mold level L, which is measured by the molten metal level gauge 26, and the stopper opening x, which is measured by the stopper opening measuring instrument 42, are also input into the flow disturbance estimation instrument 44.

The flow disturbance estimation instrument 44 computes the flow disturbance estimate $\widehat{qw}$ on the basis of the measured value V of the casting speed, the measured value L of the molten metal level and the measured value x of the stopper opening and then inputs $\widehat{qw}$ into the correction amount computing unit 46.

The flow disturbance estimation instrument 44 estimates the flow disturbance as follows: A process model which describes how the input flow q which is determined by the position of the stopper 28 and the flow gain, the molten metal level L and the flow fluctuation qw vary with time is created, with the molten metal level L being determined by the accumulation of the difference between the input flow q and the output flow Qo, which is determined by the casting speed V, plus the flow fluctuation qw caused by the disturbance in the mold 18. The measured stopper opening value x and the measured casting speed value V are entered into the process model. The error between the estimated molten metal level and the measured molten metal level, the former being obtained from the process model, is fed back into the process model which eliminates the difference between the estimate and the measured value. The error between the estimated and measured molten metal level arising in the computation process is integrated and the flow fluctuations qw caused by the disturbance is estimated.

Thereafter, the molten metal level L in the mold 18 can be maintained at a constant level by proceeding in exactly the same manner as shown for the first embodiment.

In this embodiment, flow fluctuations caused by the influence of the casting speed V are considered separately. Therefore the contribution from the casting speed V is not involved in the flow fluctuation estimate $\hat{qw}$. If feed-forward control of the casting speed is used at the same time, then it suffices to input $\hat{qw}$ added by the term of the feed-forward control of the casting speed, into the correction amount computing unit 46. The details of this are given in the description of the fourth embodiment.

In the following the fourth embodiment will be described in detail.

The fourth embodiment uses the same molten metal level control device as the third embodiment. However, the stopper opening measuring instrument 42 is omitted, and, as indicated by the broken line in FIG. 8, the flow fluctuation qw is estimated using the position command value Pr for the stopper controller 30.

The flow fluctuation qw caused by disturbances is estimated as follows in the fourth embodiment: A process model which describes how the position command value Pr for the stopper 28, the input flow q, the molten metal level L and the flow fluctuation qw vary with time is created, with the input flow q being determined by characteristic of the stopper controller 30, the characteristic relation between the position of the stopper 28 and the input flow into the mold, and the position of the stopper 28, the molten metal level L being determined by the accumulation of the difference between the input flow q and the output flow Qo, which is determined by the casting speed V, plus the flow fluctuation qw caused by the disturbance in the mold 18. The stopper position command value Pr and the measured value V of the casting speed are input into this process model and the error between the molten metal level estimate and the measured molten metal level, the former being obtained from the process model, is fed back into the process model which eliminates the difference between the estimate and the measured value. Integration of the error between the estimate and the measured value of the molten metal level arising in the computation process is performed and the flow fluctuation qw caused by the disturbance is estimated.

In the following, mathematical expressions are used to give a detailed description of the flow disturbance estimation employed by the fourth embodiment.

Figure 9:
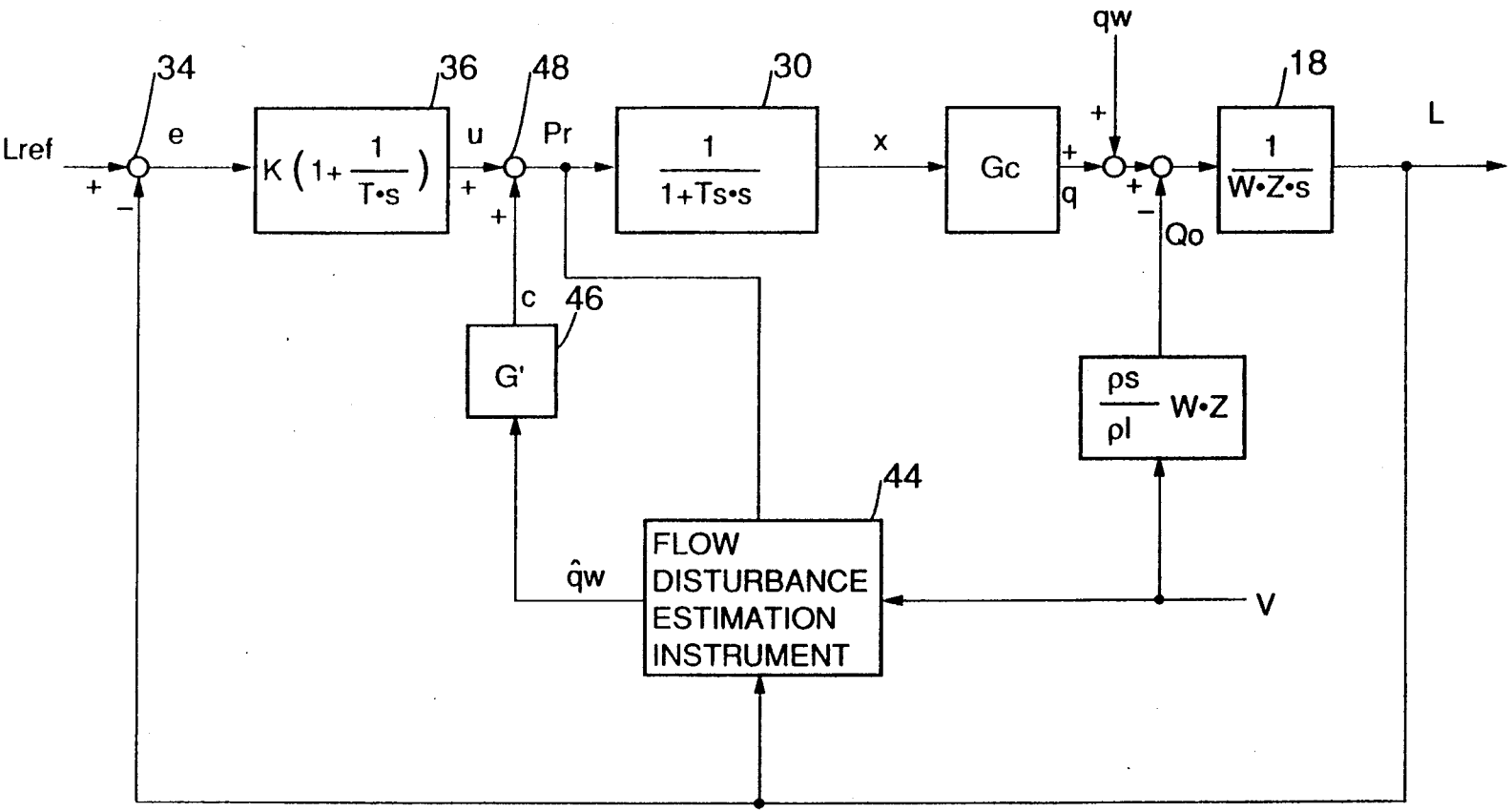
FIG. 9 is a block diagram showing the molten metal level control device using transfer functions to explain the method employed by the flow disturbance estimation instrument to estimate flow disturbances.

FIG. 9 uses transfer functions to represent the molten metal level control system shown in FIG. 8. FIG. 9 corresponds to FIG. 3 which was used for the description of the second embodiment. Qo represents output flow fluctuations, which are caused by the casting speed (amount of variation) V, and $\partial Qo/\partial V$ is an influence coefficient indicating the influence of the casting speed V on the output flow fluctuation Qo. Using the mold width W, the mold thickness Z and the density ratio $\rho s/\rho l$ of the solid and liquid steel, then the influence coefficient $\partial Qo/\partial V$ is expressed as $(\rho s/\rho l)\cdot W\cdot Z$. Also, the characteristic of the casting speed meter 40 is approximated by 1 so that the casting speed V can be directly measured.

If all other conditions are assumed to be the same as for the second embodiment, then the relation between the stopper position command value Pr, the stopper position x, the molten metal flow q into the mold 18, the flow disturbance qw and the molten metal level L is represented by the following formulas:

$$x=\{1/(1+T_s\cdot S)\}\cdot Pr \tag{14}$$

$$q=G_c\cdot x \tag{15}$$

$$L=1/(W\cdot Z\cdot s)\times\{q-(\rho s/\rho l)\cdot W\cdot Z\cdot V+qw\} \tag{16}$$

As in expression (8), the variation $\dot{q}w$ of the flow disturbance qw with time is assumed to be zero. In symbols, $$\dot{q}w=0 \tag{17}$$

Then formulas (14)–(17) can be combined and expressed as follows:

$$\begin{pmatrix}\dot{L}\\ \dot{q}\\ \dot{q}w\end{pmatrix}=\begin{pmatrix}0 & 1/W\cdot Z & 1/W\cdot Z\\ 0 & -1/T_s & 0\\ 0 & 0 & 0\end{pmatrix}\times\begin{pmatrix}L\\ q\\ qw\end{pmatrix}+\begin{pmatrix}0 & -\rho s/\rho l\\ G_c/T_s & 0\\ 0 & 0\end{pmatrix}\times\begin{pmatrix}Pr\\ V\end{pmatrix} \tag{18}$$

Formula (18) corresponds to formula (9). It is a model which describes how the molten metal level L, the input flow q into the mold 18 and the flow disturbance qw vary with time.

If processing is performed in the same manner as in the second embodiment on the basis of formula (18), then the following formula, which corresponds to expression (11), is obtained:

$$\begin{pmatrix}\dot{\hat{L}}\\ \dot{\hat{q}}\\ \dot{\hat{qw}}\end{pmatrix}=\begin{pmatrix}-g1 & 1/W\cdot Z & 1/W\cdot Z\\ -g2 & -1/T_s & 0\\ -g3 & 0 & 0\end{pmatrix}\times\begin{pmatrix}L\\ q\\ qw\end{pmatrix}+\begin{pmatrix}\hat{g1} & 0 & -\rho s/\rho l\\ \hat{g2} & G_c/T_s & 0\\ \hat{g3} & 0 & 0\end{pmatrix}\times\begin{pmatrix}L\\ Pr\\ V\end{pmatrix} \tag{19}$$

Similar to the third embodiment, the flow disturbance caused by the casting speed V is not involved in the flow disturbance qw and the flow disturbance estimate $\hat{qw}$. It is therefore easy to combine qw and $\hat{qw}$ with the feed-forward control of the casting speed. The configuration for this case is shown in the block diagram of FIG. 10 which, in addition to FIG. 9, comprises an adder 51 used to add the feed-forward gain 50 and the feed-forward signal. The characteristic $G_{vr}$ of the feed-forward gain 50 from the casting speed V is represented by the following formula $$G_{vr}=(\rho s/\rho l)\cdot W\cdot Z/G_c \tag{20}$$

If feed-forward control of the casting speed is used at the same time, then the stopper position command value Pr, which is the sum of the output u from the PID controller 36 and the output c from the correction amount computing unit 46 plus the amount of change of the casting speed V multiplied by the gain Gvr, is sent to the stopper controller 30.

In the above description, the characteristic of the molten metal level gauge 26, the casting speed meter 40, etc. is approximated by 1. However, if the flow disturbance estimation instrument 44 is built with the characteristic of the molten metal level gauge 26, the casting speed meter 40, etc. being represented by a first order time lag system, then the time lag can be taken into consideration.

Figure 10:
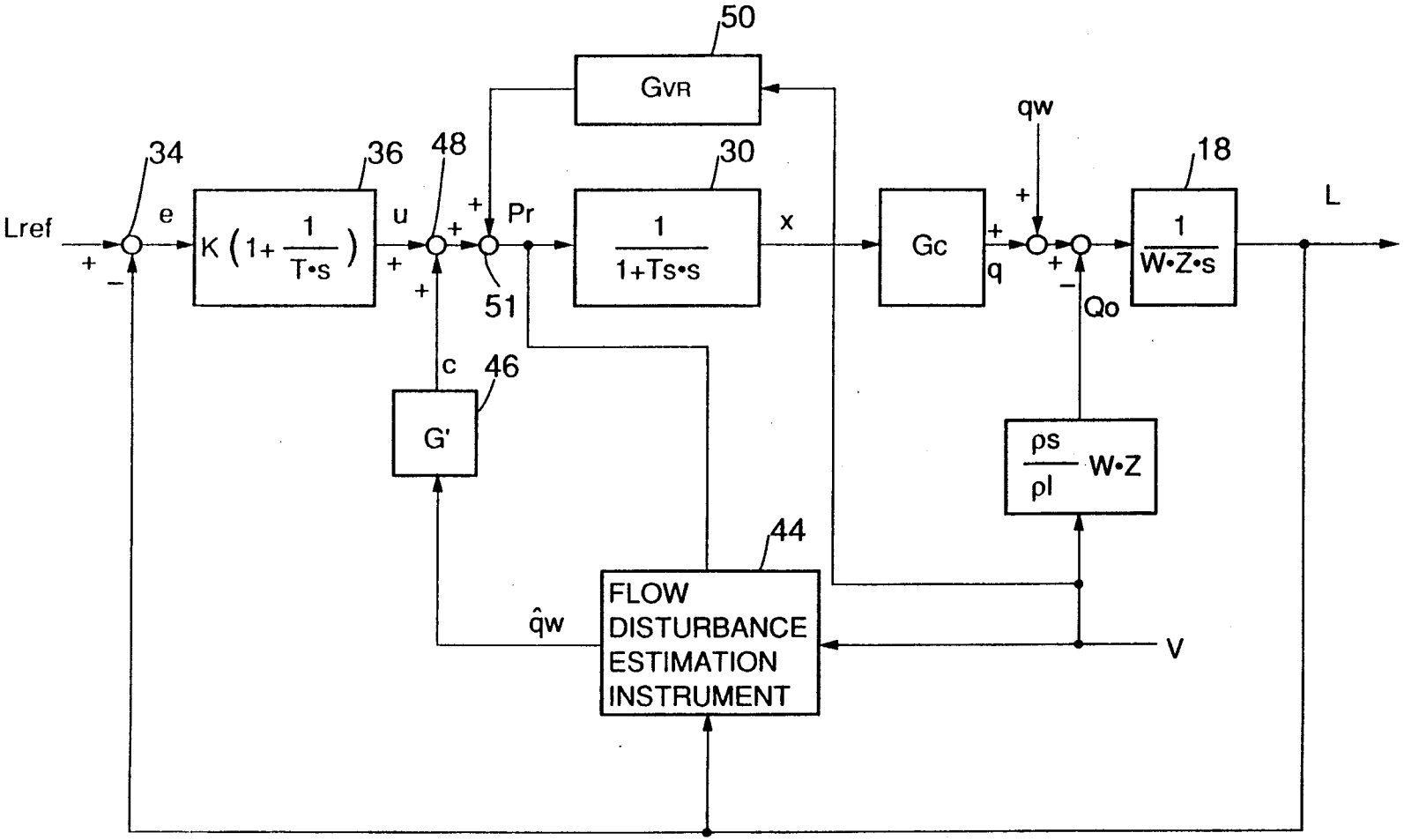
FIG. 10 is block diagram corresponding to FIG. 7 for the case in which feed-forward control is employed for the casting speed.
Figure 11A:
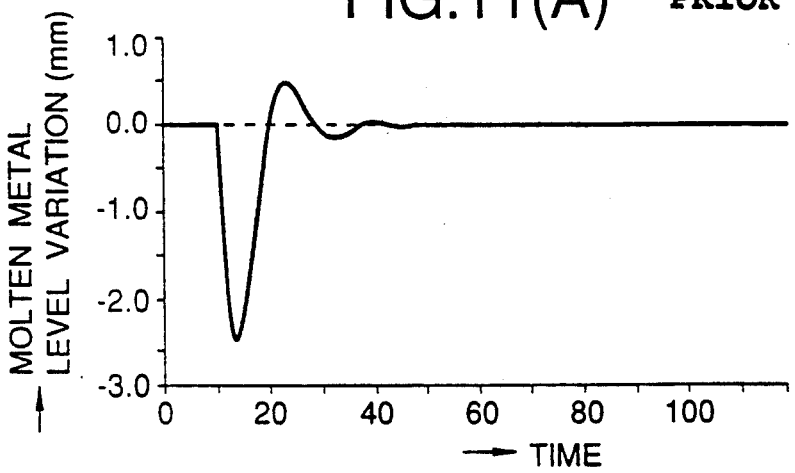
FIG.11(A) PRIOR ART
FIG. 11(A) is a diagram showing the result of a numerical experiment in which the control performance is of conventional PI control.
Figure 11B:
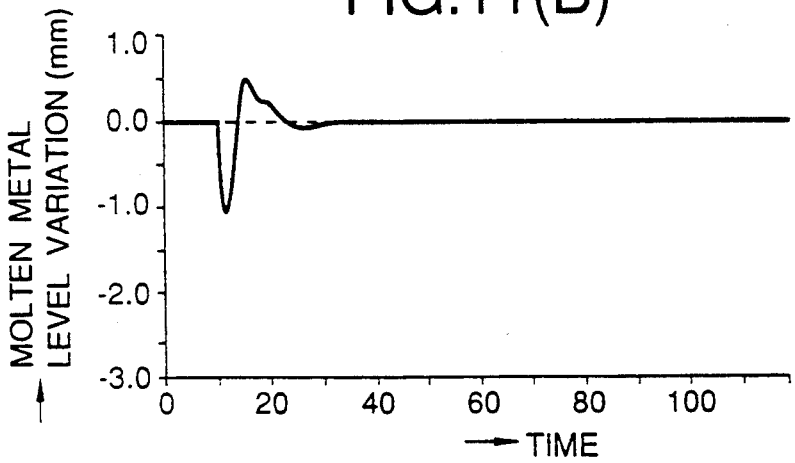
FIG. 11(B) and 11(C) show the control method according to the present invention comparing two (2) casting speeds one changed by a step increment of 10%.
Figure 11C:
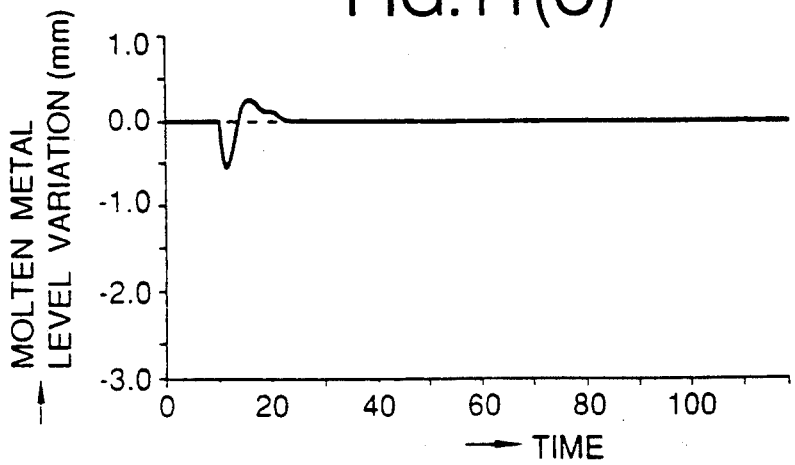

FIG. 11 shows the result of a numerical experiment in which the control performance is analysed for the case when the casting speed is increased by step in 10 percent increment. FIG. 11 (A) illustrates the case of conventional PI control only, FIG. 11 (B) illustrates the case (second embodiment) when, using the configuration shown in FIG. 3, the flow disturbance estimate $\hat{qw}$ contains the fluctuation of the casting speed V and FIG. 11 (C) illustrates the case (this embodiment) when, using the configuration shown in FIG. 10, qw itself does not include the flow fluctuation caused by variation of V but is combined with the separate feed-forward control. As shown in FIG. 11 (A), in a control system which uses only PI control the range of variation of the molten metal level is −2.48 to +0.52 mm so that the total variation amounts to 3.00 mm. Contrary to this, if a control system with the configuration according to the present invention as shown in FIG. 3 is used, then the range of variation of the molten metal level is −1.09 to +0.54 mm so that total variation is 1.63 mm, as shown in FIG. 11 (B). Furthermore, if a control system with the configuration shown in FIG. 10 is used, then the range of variation of the molten metal level is −0.59 to +0.29 mm so that the total variation is 0.88 mm, as shown in FIG. 11 (C). This means that the range of variation is cut down to respectively 54 and 29 percent of the range of variation of the PI control system. From this it is obvious that the present invention offers control performances which provide outstanding control of molten metal level fluctuations caused by changes in the casting speed.

Since the first and second embodiment differ from the third and fourth embodiment in that the flow disturbance estimate $\hat{qw}$ contains the flow disturbances caused by fluctuations of the casting speed V, it is not necessary to take the trouble to perform feed-forward control of the casting speed. However, to avoid overlapping when feed-forward control of the casting speed V is also used, the position command value Pr for the flow control actuator or the measured value x of the flow control actuator, which are used to estimate the flow disturbance qw, should be such that these values are equal to the respective actual Pr or x values minus the component of the feed-forward control of the casting speed.

For each of the above-described embodiments, a model which describes the dynamic behaviour of the molten metal injection system is created. The inputs and outputs of the molten metal injection system, that is the stopper position command value Pr, the measured stopper position value x and the measured value L of the molten metal level, and in addition to this in the third and fourth embodiment the casting speed V are input into this model. The error between the obtained estimate and actual value of the molten metal level is fed back into the input of the model to gradually decrease the error to zero. The flow fluctuation caused by disturbances is estimated using the flow disturbance value generated by the model during this computation process. However, the present invention is not restricted to the use of such a model.

Figure 12:
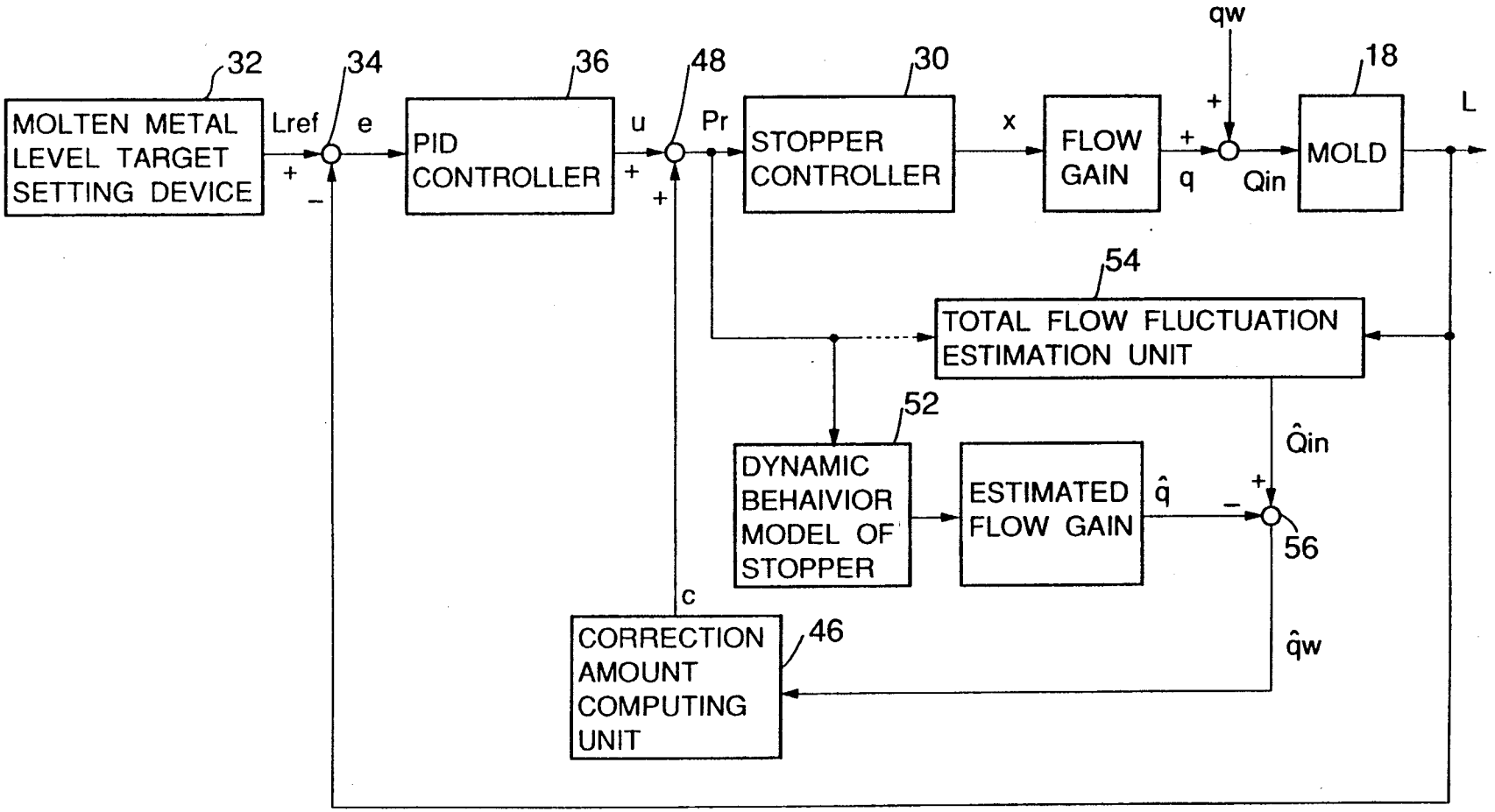
FIG. 12 is a block diagram showing the configuration of still another embodiment of the molten metal level control system according to the present invention.

In the following, the fifth embodiment according to the present invention will be described with reference to FIG. 12. In FIG. 12 the influence resulting from changes in the casting speed is omitted.

The fifth embodiment is an example to which claim 6 is applied. The molten metal level control device is equipped with a model 52 which describes the dynamic behaviour of the stopper (actuator) and a flow gain, which are used to calculate the estimate of the input flow using the stopper position command value Pr, a total flow fluctuation estimation unit 54 used to compute the estimate of the total flow fluctuation in the mold 18 using the molten metal level L, and a subtractor 56 which computes the estimate of the flow fluctuation caused by disturbances from the difference between the estimate of the input flow and the estimate of the total flow fluctuation and then outputs this estimate to the correction amount computing unit 46.

If the total flow fluctuation for the mold 18 is assumed to be Qin, then the relation between Qin, the input flow fluctuation q and the flow disturbance qw is expressed by the following formula:

$$Qin = q + qw \tag{21}$$

It is assumed that the time when the control is started is the reference point of time and that Qin=qw=q=0 at that point of time. If, under these conditions, the stopper position command value Pr is input into the model 52, which describes the dynamic behaviour of the stopper, then it is possible to obtain the estimate $\hat{q}$ of the input flow fluctuation q from the model 52 and the estimate of the flow gain. Accordingly, if the total flow fluctuation Qin can be estimated, then the flow disturbance estimate $\hat{qw}$ can be determined using the following formula.

$$\hat{qw} = \hat{Qin} - \hat{q} \tag{22}$$

In expression (22), $\hat{Qin}$ denotes the estimate of the total flow fluctuation. For example, $\hat{qw}$ can be determined as follows:

Using equations (5)–(7) allows to express equation (22) as $$qw = W \cdot Z \cdot s \cdot L - G_c/(1 + T_s \cdot s) \times Pr \tag{23}$$

Expression (23) allows the flow disturbance qw to be determined from the stopper position command value Pr and the molten metal level L. In this case the derivative of the molten metal level L is required so that this case is not practical if L contains noise. However, noise can be eliminated by using the approximation shown in the following formula:

$$s \cdot L \simeq s/(1 + T_L \cdot s) \cdot L \tag{24}$$

where $T_L$ is an appropriate positive value.

$\hat{Qin}$ can also be determined by substituting for the flow disturbance estimate $\hat{qw}$ and the input flow estimate $\hat{q}$ in equation (21), where $\hat{qw}$ and $\hat{q}$ are obtained by solving differential equation (11). Furthermore, to determine $\hat{Qin}$ any other publicly known noise elimination means can be used.

Also, the characteristic of the stopper control system need not be restricted to the time lag of first order model given by the expression (23). For example, if the play of a mechanical system, the transmission lag of an electrical system, etc. are taken into consideration, then the flow disturbance qw can also be expressed by the following formula:

$$qw = W \cdot Z \cdot s \cdot L - G_c \cdot e^{-Td \cdot s}/(1 + T_s \cdot s) \times Pr \tag{25}$$

where Td is a invalid time.

From the definition of the input flow q it is obvious that the flow disturbance estimate $\hat{q}w$ represents the influence on the flow since the reference point of time, that is flow fluctuations caused by a nozzle clogged with deposits, peeling off of the deposits, changes in the casting speed, bulging, etc..

Accordingly, the following procedure provides control of the molten metal level L so as to establish the target value of the molten metal level.

To determine the flow disturbance estimate $\hat{q}w$, the subtractor 56 executes formula (22) by using the estimated total input flow $\hat{Q}in$ and the input flow estimate $\hat{q}$, which is determined from the model 52, which describes the dynamic behaviour of the stopper, and the estimate of the flow gain. Then the correction signal c, used to offset the flow disturbance estimate $\hat{q}w$, is generated via the correction amount computing unit 46. Thereafter, the adder 48 adds the correction signal c to the command value u, which is output from the PID controller 36, to force the molten metal level to establish its target value. Substituting this sum for the stopper position command value Pr allows to suppress flow disturbances before fluctuations of the molten metal level occur. As a result, molten metal level fluctuations can be suppressed.

That is, as expressed by formula (22), the special feature of the present invention is that only the portion of the fluctuation, which is caused by disturbances, is extracted from the fluctuation of the flow into and out of the mold, i.e. the portion of the fluctuation after deduction of the fluctuation caused by the control itself, and that this portion of the fluctuation is fed forward. This provides an outstanding control performance which cannot be found in other feedback control systems.

In the following the sixth embodiment of the present invention will be described in detail. It is assumed that the input flow control actuator is a stopper, that the dynamic characteristic relation between the input flow q into the mold and the stopper position command value Pr is represented by a time lag of first order $1/(1+T\cdot s)$ and that the dynamic characteristic relation between the input flow q and the molten metal level L is represented by an integral. To embody the sixth embodiment, claim 7 is applied.

Figure 13:
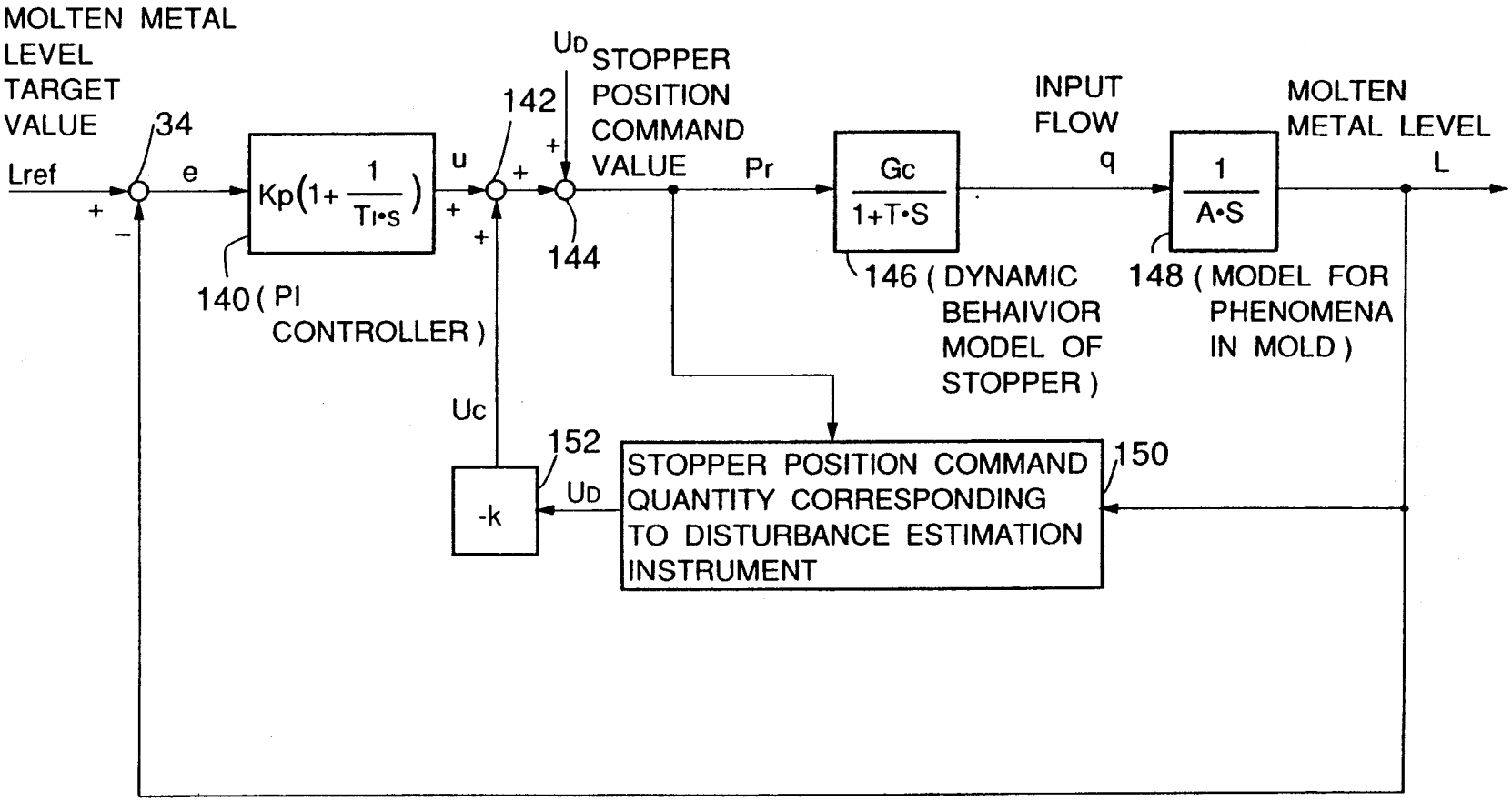
FIG. 13 is a block diagram showing the configuration of the sixth embodiment of the molten metal level control method for continuous casting according to the present invention.

As shown in FIG. 13, the sixth embodiment according to the present invention is composed of a comparator 34 which compares the detected value L to the target value Lref of the molten metal level and outputs the deviation e, a PI controller 140 which computes a stopper position command value u, which eliminates the deviation e, using predetermined control parameters (the proportional gain $K_P$ and a time constant $T_I$) and which performs proportional integral (PI) control, an adder 142 which adds the stopper command value u and the correction signal Uc, which is described below, so that the sum becomes the actual command value Pr for the stopper position, an adder 144 which shows that a virtual stopper position command quantity $U_D$, which corresponds to the disturbance, is added to the output from the adder 142, a model 146 for the dynamic behaviour of the stopper which describes the relation between the actual stopper position command value Pr, added by the stopper position command quantity $U_D$ corresponding to the disturbance, and the input flow q into the mold, a model 148 for phenomena in the mold, which describes the relation between the input flow q and the molten metal level L in the mold, a stopper position command quantity estimation instrument 150 used to estimate the stopper position command quantity $U_D$ corresponding to the disturbance, with $U_D$ corresponding to the difference between the predicted value of the molten metal level and the actual detected value of the molten metal level, the former being output from the model 148 for phenomena in the mold, a correction coefficient multiplier 152 which is used to multiply $U_D$ by a correction coefficient $-k$ to eliminate the stopper position command quantity $U_D$ corresponding to the disturbance and which outputs the result to the adder 142.

In FIG. 13, s denotes the Laplace operator, Gc denotes the flow coefficient of the stopper, T denotes a time constant and A denotes the cross-sectional area of the mold.

In the following, the function of the sixth embodiment will be described.

The molten metal level L is maintained at a desired level as follows: The comparator 34 compares the detected value L of the molten metal level to the target value Lref of the molten metal level and inputs the deviation e between the two values into the PI controller 140. The stopper position command value u, which is computed by the PI controller 140, is output to the adder 42. Furthermore, the adder 42 adds the stopper position command value u and the correction signal Uc, the result being the stopper position command value Pr, and outputs the stopper position command value Pr to the stopper controller.

In the following the way how the correction signal Uc is generated is described.

For clogging of the nozzle, peeling off of deposits which cause clogging of the nozzle and irregular fluctuations of the molten metal level which are called bulging, it is assumed that the above-described disturbances are caused by the behaviour of a virtual stopper. Furthermore, if the virtual stopper position command quantity corresponding to the disturbance is assumed to be $U_D$, then the control model for the molten metal level is represented by the following state equation (26):

$$\begin{pmatrix} dL/dt \\ dq/dt \\ dU_D/dt \end{pmatrix} = \begin{pmatrix} 0 & 1/A & 0 \\ 0 & -1/T & G_c/T \\ 0 & 0 & 0 \end{pmatrix} \times \begin{pmatrix} L \\ q \\ U_D \end{pmatrix} + \begin{pmatrix} 0 \\ G_c/T \\ 0 \end{pmatrix} \times \begin{pmatrix} Pr \end{pmatrix} \quad (26)$$

where

A: cross-sectional area of the mold

T: a constant which represents the dynamic behaviour of the stopper $G_c$: flow coefficient d/dt: differential operator.

Accordingly, in the stopper position command quantity estimation instrument 150, used to estimate the virtual stopper position command quantity $U_D$ corresponding to the disturbance, the actual stopper position command value Pr is substituted for Pr in equation (26) to estimate the molten metal level L. Successively feeding back the difference between the estimate $\hat{L}$ of the molten metal level and the detected value L of the molten metal level into the model using the following formula allows to eliminate the difference between the detected value and predicted value of the molten metal level. The virtual stopper position command quantity $U_D$ for clogging of the nozzle caused by deposits, peeling off of the deposits or bulging can be estimated in the course of this computation process.

$$\begin{pmatrix} d\hat{L}/dt \\ d\hat{q}/dt \\ d\hat{U}_D/dt \end{pmatrix} = \begin{pmatrix} 0 & 1/A & 0 \\ 0 & -1/T & G_c/T \\ 0 & 0 & 0 \end{pmatrix} \times \begin{pmatrix} \hat{L} \\ \hat{q} \\ \hat{U}_D \end{pmatrix} \times \begin{pmatrix} 0 \\ G_c/T \\ 0 \end{pmatrix} \times \begin{pmatrix} Pr \end{pmatrix} + \begin{pmatrix} g1 \\ g2 \\ g3 \end{pmatrix} \times (L - \hat{L}) \quad (27)$$

where g1, g2, g3 are constants and indicates estimates.

The stopper correction signal Uc which offsets the stopper position command quantity $U_D$ corresponding to the disturbance is computed according to the following formula:

$$U_C = -k \times \hat{U}_D \quad (28)$$

where k is a constant.

Figure 14:
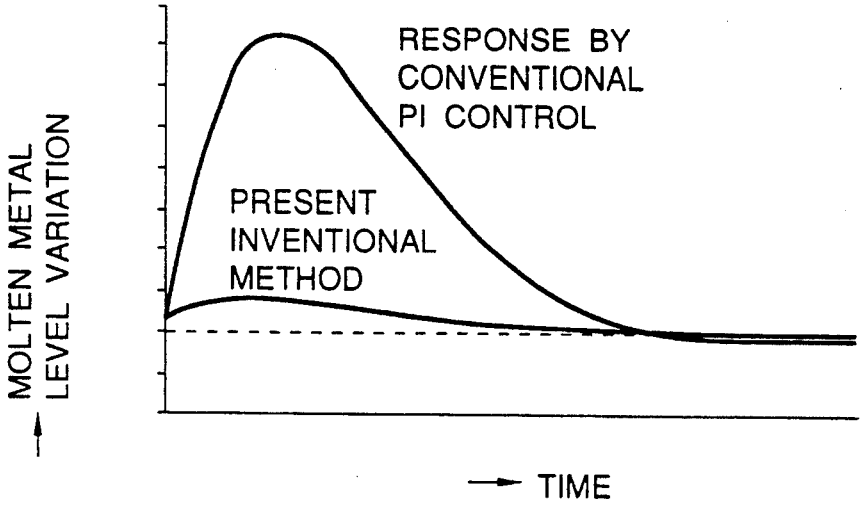
FIG. 14 is a diagram showing a comparison between the response of the sixth embodiment and the response of a conventional example.

FIG. 14 illustrates the molten metal level control of the sixth embodiment for a case in which deposits that cause clogging of the nozzle peel off. From FIG. 14 it is obvious that the amount of fluctuation of the molten metal level is small as compared to conventional PI control.

In the sixth embodiment it is assumed that the virtual stopper position command quantity $U_D$, being in accordance with the peeling off of deposits in the nozzle and the like, has the same features as the model 146 for the dynamic behaviour of the stopper and represents the input flow into the mold. However, the range of application of the present invention is not restricted to this. For example, in the same manner as in the seventh embodiment shown in FIG. 15, it may also be assumed that the dynamic behaviour of $U_D$ differs from that of the stopper and that $U_D$ represents the input flow into the mold.

Figure 15:
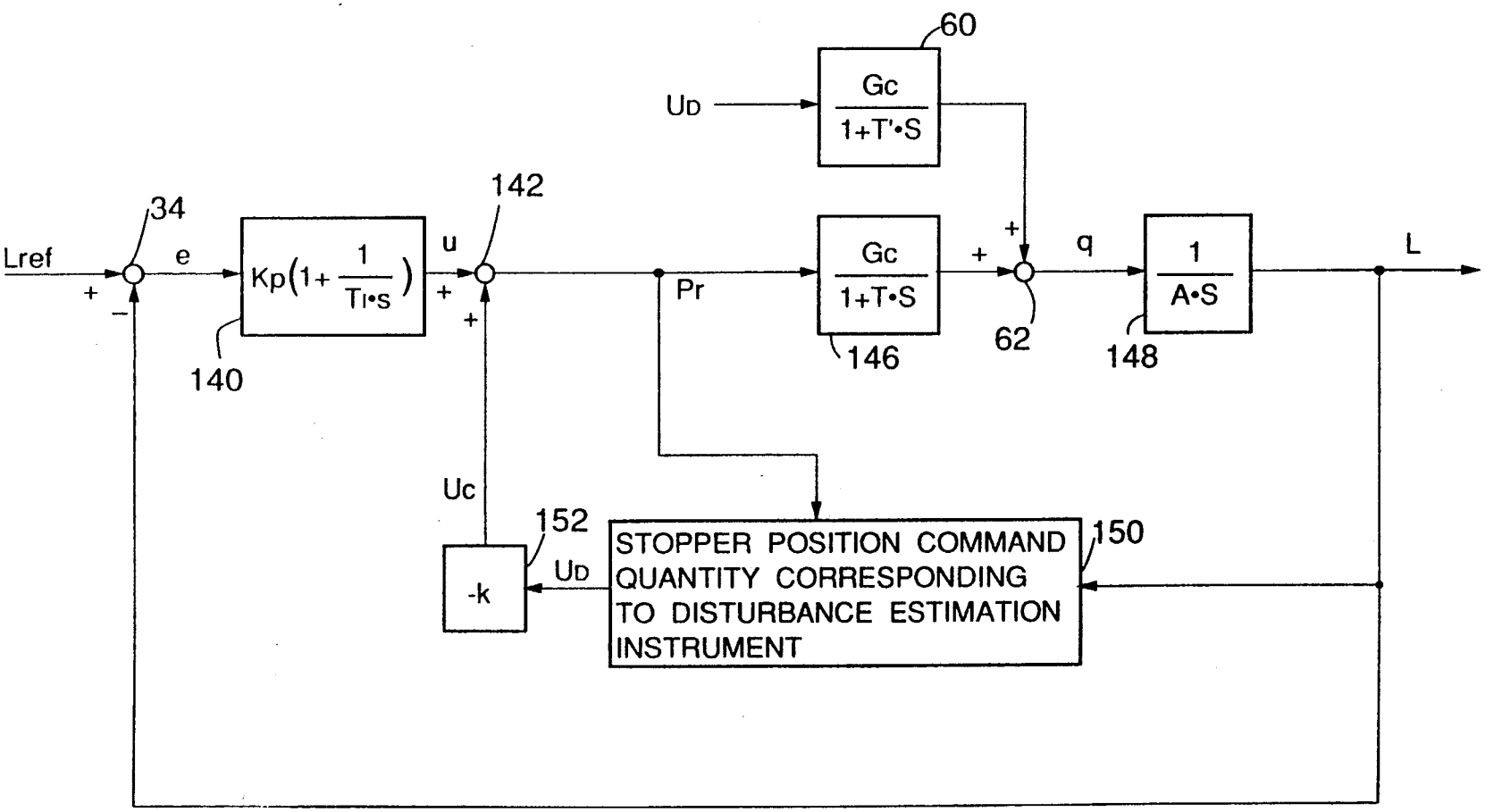
FIG. 15 is a block diagram showing the configuration of the seventh embodiment according to the present invention.

In FIG. 15, reference numeral 60 denotes a simulation model for the dynamic behaviour of the stopper in case of disturbances and reference numeral 62 denotes an adder.

In the seventh embodiment, the virtual stopper position command quantity $U_D$ can be estimated using formulas equivalent to formulas (26) and (27) and following the above described procedure. The molten metal level L can be controlled using expression (28).

In the following, the eighth embodiment according to the present invention will be described on the basis of the drawings.

Figure 16:
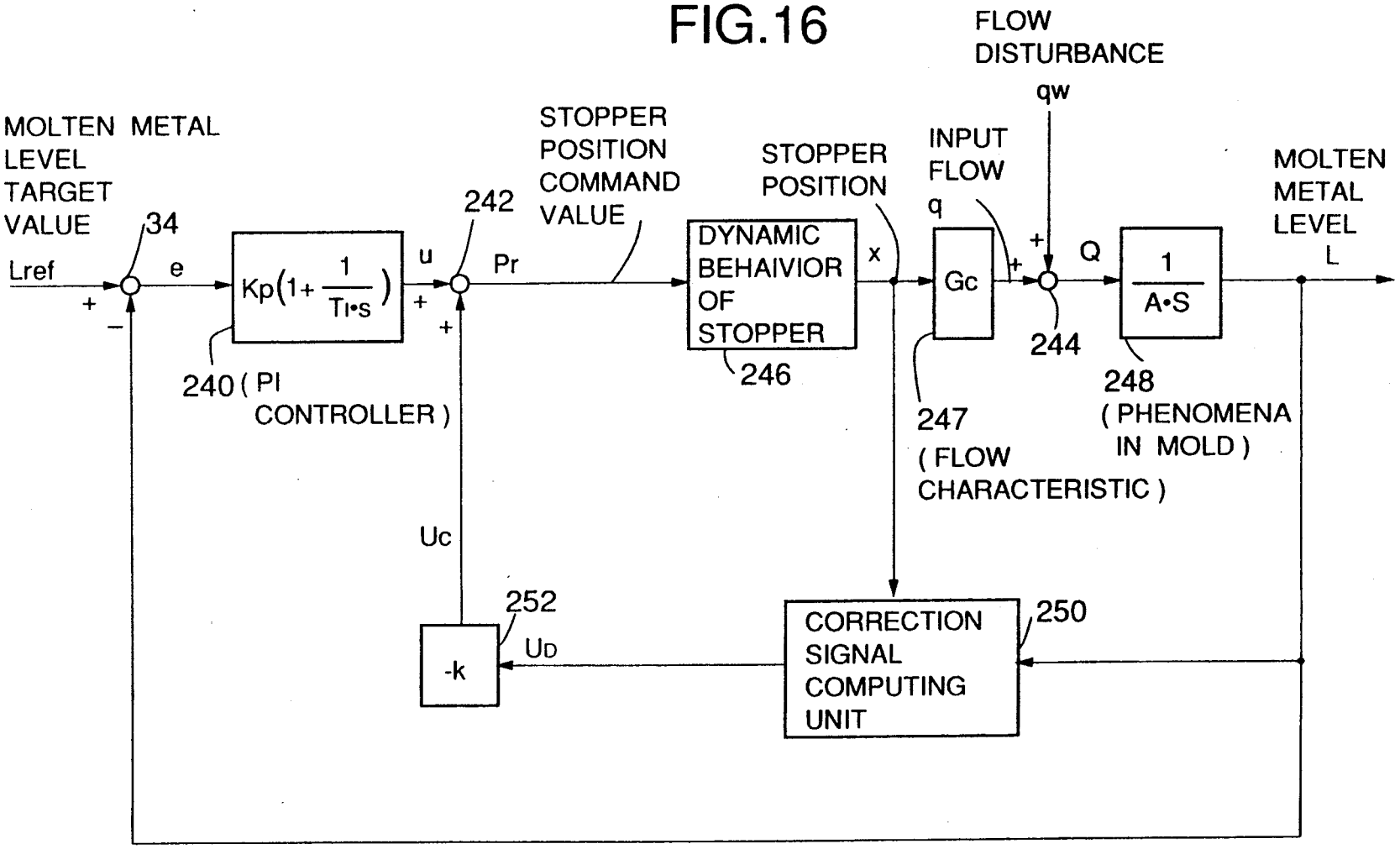
FIG. 16 is a block diagram showing the configuration of the eighth embodiment of the molten metal level control method for continuous casting according to the present invention.
Figure 21:
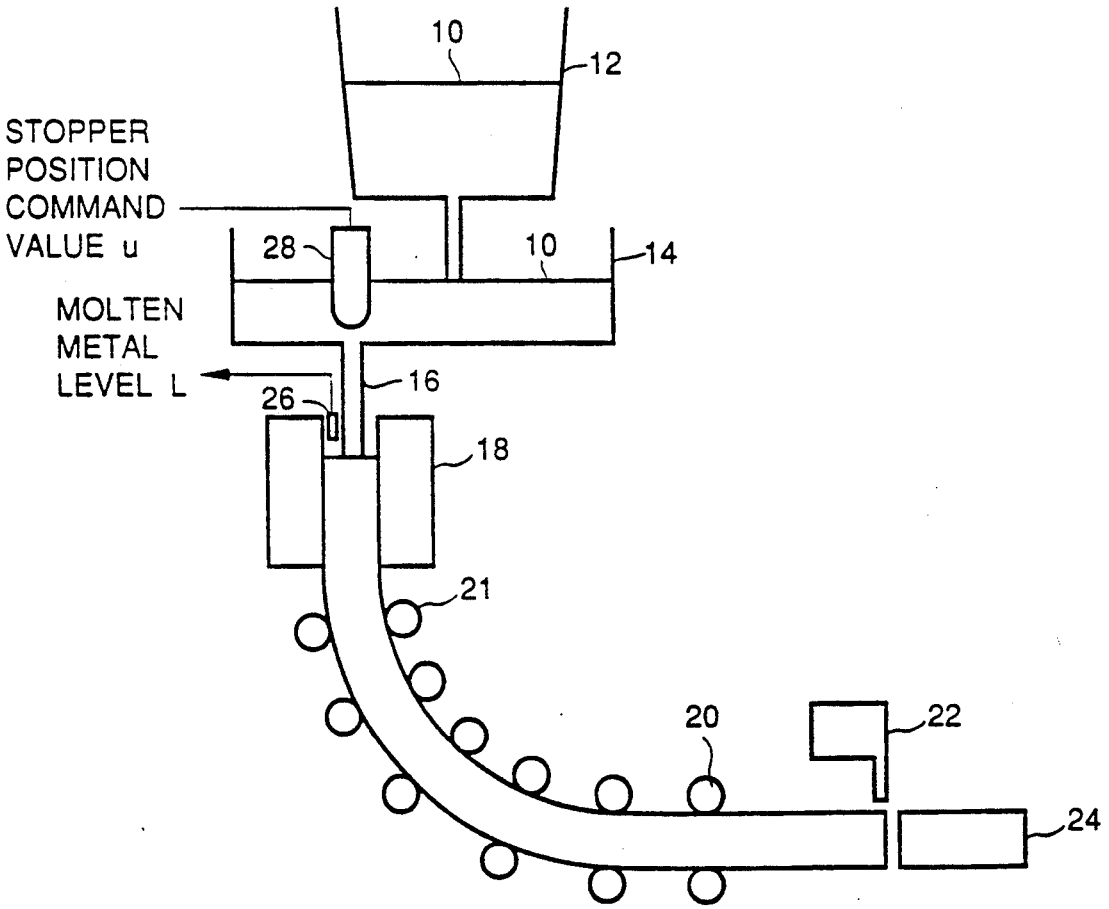
FIG.21 PRIOR ART
FIG. 21 is a drawing showing the overall configuration of a continuous casting machine to which the present invention is applicable.
Figure 22:
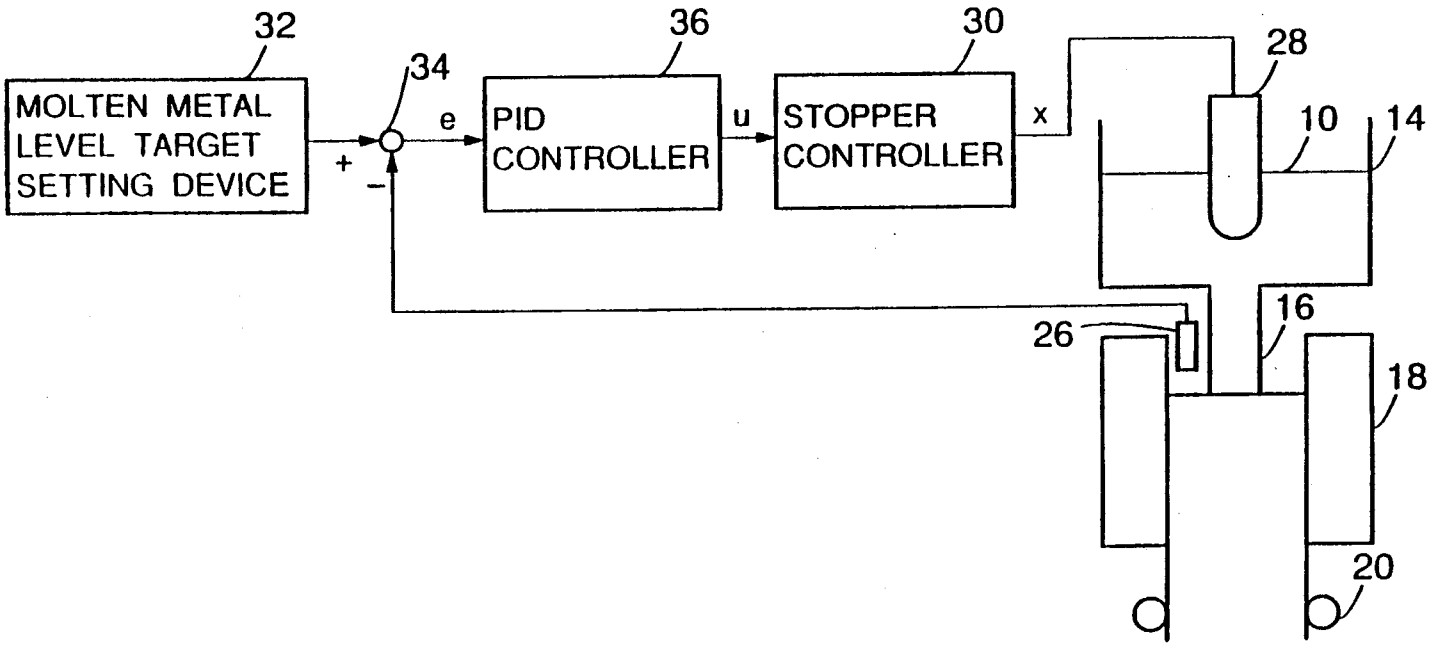
FIG.22 PRIOR ART
FIG. 22 is a block diagram showing the configuration of a conventional molten metal control system.

FIG. 16 is a block diagram showing the eighth embodiment according to the present invention. The continuous casting machine of FIG. 21 is applied to this embodiment.

For the description of this embodiment, it is assumed that the flow control actuator is the stopper 28, that the input flow q into the mold 18 is proportional to the actual stopper position value x (the proportional coefficient is the flow coefficient $G_C$ (flow gain)) and that the dynamic characteristic relation between the input flow q and the molten metal level L is represented by an integral.

In FIG. 16, reference numeral 34 denotes a comparator which compares the target value Lref of the molten metal level to the molten metal level L detected by the molten metal level gauge 26 and outputs the deviation e (e=Lref−L).

Reference numeral 240 denotes a PI controller used to perform proportional integral (PI) control. Using predetermined control parameters (proportional gain $K_P$ and integral time $T_I$), the PI controller 240 computes the stopper position command value u which gives the instruction to establish the position of the stopper 28 so as to eliminate the deviation e that is input from the comparator 34. The PI controller 240 then outputs the stopper position command value u to the adder 242.

The adder 242 adds the stopper position command value u and the stopper correction signal Uc, the latter being described later, and then outputs the result as the actual command value Pr for the stopper position.

246 shows the dynamic behaviour of the stopper 28 which is controlled by the actual stopper position command value Pr, which is output from the adder 242. The actual position of the stopper 28, after being controlled by the stopper position command value Pr, is output as actual stopper position value x.

247 shows the flow characteristic of the mold 18. The input flow q of molten steel 10, which flows from the nozzle 16 into the mold 18, is output while maintaining its proportional relation with the actual stopper position value x, which is determined by the dynamic behaviour 246 of the stopper (the proportional coefficient is the flow coefficient Gc).

244 is an adder, which adds the flow disturbance qw to the input flow q when a flow disturbance occurs, and which shows that the total input flow Q of the molten steel 10 flows into the mold 18.

248 shows the phenomena in the mold 18 into which the total input flow Q of the molten steel 10 has flowed. The molten metal level L is determined by the total input flow Q. A denotes the cross-sectional area of the mold 18 and S denotes the Laplace operator.

The feedback control loop, which acts to eliminate the difference between the detected value L and the target value Lref of the molten metal level, is formed according to the above-described configuration. Further, this embodiment involves an additional disturbance elimination control loop which is composed of a correction signal computing unit 250 and a correction coefficient multiplier 252.

The correction signal computing unit 250 computes the estimate $\hat{qw}$ of the flow disturbance and the derivative $\hat{qw}$ thereof from the actual stopper position value x and the detected value L of the molten metal level, the former being determined by the dynamic behaviour 246 of the stopper. Furthermore, using the estimates $\hat{qw}$ and $\hat{qw}$ the correction signal computing unit 250 computes and outputs the stopper correction command value $U_D$ which is used to offset the flow disturbance qw caused by phenomena such as clogging of the nozzle 16, bulging, etc. It should be noted that is possible to omit the computation of the derivative $\hat{qw}$, and compute the stopper correction command value $U_D$ using only the estimate $\hat{qw}$ of the flow disturbance.

The correction signal computing unit 250 uses the following control model to compute $\hat{qw}$ and $\hat{qw}$.

As the flow disturbance qw caused by phenomena such as clogging of the nozzle, bulging, etc. is changing every moment, it is necessary that the assumed flow disturbance can follow the variation of the actual flow disturbance qw with time.

Accordingly, a model which assumes a sine-shaped or ramp-shaped variation of the flow disturbance is appropriate.

This model assumes a sine-shaped variation of the flow disturbance. This allows to perform an excellent disturbance estimation for the case in which periodic fluctuations of the molten metal level, called irregular bulging, occur.

If the flow disturbance qw is assumed to be a sine-shaped disturbance with frequency $\omega$ [rad/sec], then the molten metal level control model is represented by the following state equation, where d/dt denotes a differential operator.

$$\begin{pmatrix} dt/dt \\ d\,\dot{q}w/dt \\ d\,qw/dt \end{pmatrix} = \begin{pmatrix} 0, & 0, & 1/A \\ 0, & 0, & -\omega^2 \\ 0, & 1, & 0 \end{pmatrix} \begin{pmatrix} L \\ \dot{q}w \\ qw \end{pmatrix} + \begin{pmatrix} G_c/A \\ 0 \\ 0 \end{pmatrix} X \tag{29}$$

The correction signal computing unit 250 is capable of computing formula (29). The actual stopper position value x, which is determined by the stopper dynamic behaviour 246, is input into the correction signal computing unit 250. The correction signal computing unit 250 then substitutes x for x in formula (29) and computes the molten metal level $\hat{L}$. The computed molten metal level L is the estimate L of the molten metal level.

The correction signal computing unit 50 is capable of successively feeding back the difference between the estimate $\hat{L}$ and the detected value L of the molten metal level, the latter being input via the molten metal level gauge 26, to the model using the following formula (30), thereby eliminating the difference between the detected value L and the estimate $\hat{L}$ of the molten metal level. Here, g1, g2 and g3 are constants.

$$\begin{pmatrix} d\hat{L}/dt \\ d\,\hat{\dot{q}w}/dt \\ d\,\hat{qw}/dt \end{pmatrix} = \begin{pmatrix} 0, & 0, & 1/A \\ 0, & 0, & -\omega^2 \\ 0, & 1, & 0 \end{pmatrix} \begin{pmatrix} \hat{L} \\ \hat{\dot{q}w} \\ \hat{qw} \end{pmatrix} + \begin{pmatrix} \hat{G}_c/A \\ 0 \\ 0 \end{pmatrix} X + \begin{pmatrix} g1 \\ g2 \\ g3 \end{pmatrix} (L - \hat{L}) \tag{30}$$

During the computation process in accordance with this model, the correction signal computing unit 250 computes the estimate $\hat{qw}$, of the flow disturbance and the derivative $\hat{qw}$ thereof. On the basis of the estimates $\hat{qw}$ and the stopper correction command value $U_D$, which is used to offset the flow disturbance qw, is computed using formula (31). $U_D$ is then output to the correction coefficient multiplier 252. Here, k1 and k2 are constants, which are determined by the flow coefficient Gc and the dynamic behaviour 246 of the stopper.

$$U_D = k_1 \cdot \hat{qw} + k_2 \cdot \hat{\dot{q}w} \tag{31}$$

The correction coefficient multiplier 252 multiplies the stopper correction amount command value $U_D$, which is output from the correction signal computing unit 250, by $-k$ and outputs the result, the stopper correction signal Uc, to the adder 42. That is, the stopper correction signal Uc, which is output from the correction coefficient multiplier 52, is represented by the following formula:

$$U_C = -k \cdot U_D \tag{32}$$

In the following the function of the eighth embodiment will be described.

The comparator 34 compares the level L of the molten metal 10, which is detected using the molten metal level gauge 26, to the molten metal level target value Lref. The deviation e of L from Lref is input into the PI controller 240, which then outputs the stopper position command value u to the adder 242. u is used to eliminate the deviation e.

Meanwhile, the actual stopper position value x of the stopper 28 is input into the correction signal computing unit 250, which computes the estimate $\hat{qw}$ of the flow disturbance and the derivative $\hat{qw}$ thereof, using formulas (29) and (30) and then outputs the stopper correction amount command value $U_D$.

The stopper correction amount command value $U_D$ is input as stopper correction signal Uc into the adder 242 via the correction coefficient multiplier 252.

The adder 242 adds the stopper correction signal Uc and the stopper position command value u and outputs the result, the stopper position command value Pr.

This stopper position command value Pr controls the position of the stopper 28 and determines the dynamic behaviour 246 of the stopper. Since the actual stopper position command value Pr is the sum of the the stopper correction signal Uc and the stopper position command value u, the stopper 28 is controlled so as to establish a position which offsets the flow disturbance qw caused by clogging of the nozzle 16, peeling off of deposits in the nozzle, irregular bulging, etc. As a result, the molten metal level, which is formed by molten steel 10 that has flowed from the nozzle 16 into the mold 18, remains stable for all sorts of flow disturbances qw.

Thus, by taking quick and appropriate steps against all sorts of disturbances, the control method of this embodiment allows the molten metal level in the mold 18 to be kept stable.

For this embodiment, the flow disturbances qw is assumed to be a sine-shaped disturbance with frequency $\omega$ [rad/sec]. However, if the frequency $\omega$ is zero, then qw can be assumed to be a ramp-shaped flow disturbance and the correction signal computing unit 50 will be capable of computing each estimate for a ramp-shaped flow disturbance.

Figure 17A:
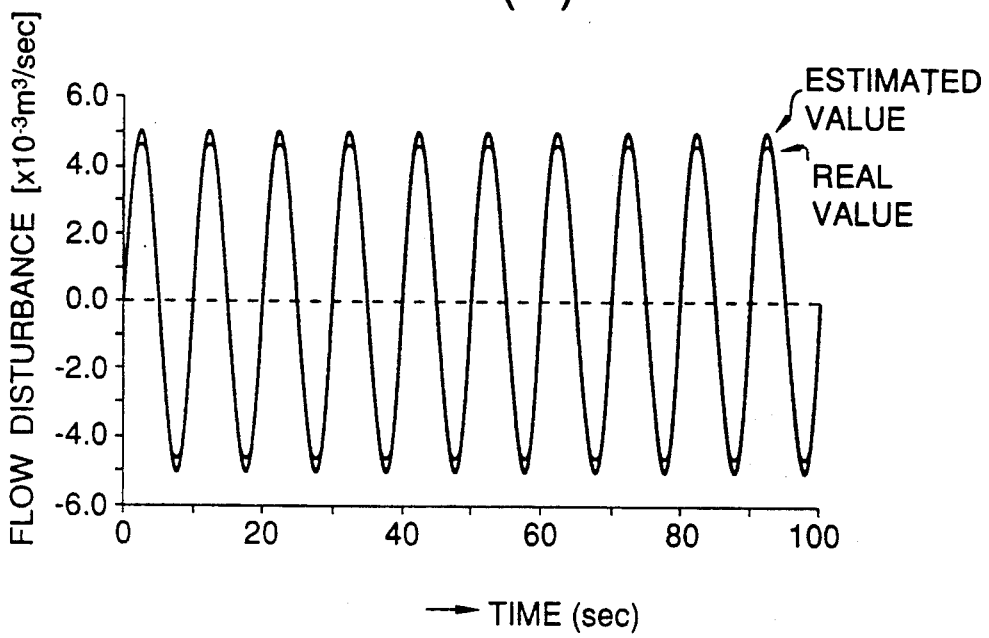
FIG. 17(A) is a diagram showing a comparison between the estimate and actual response.
Figure 17B:
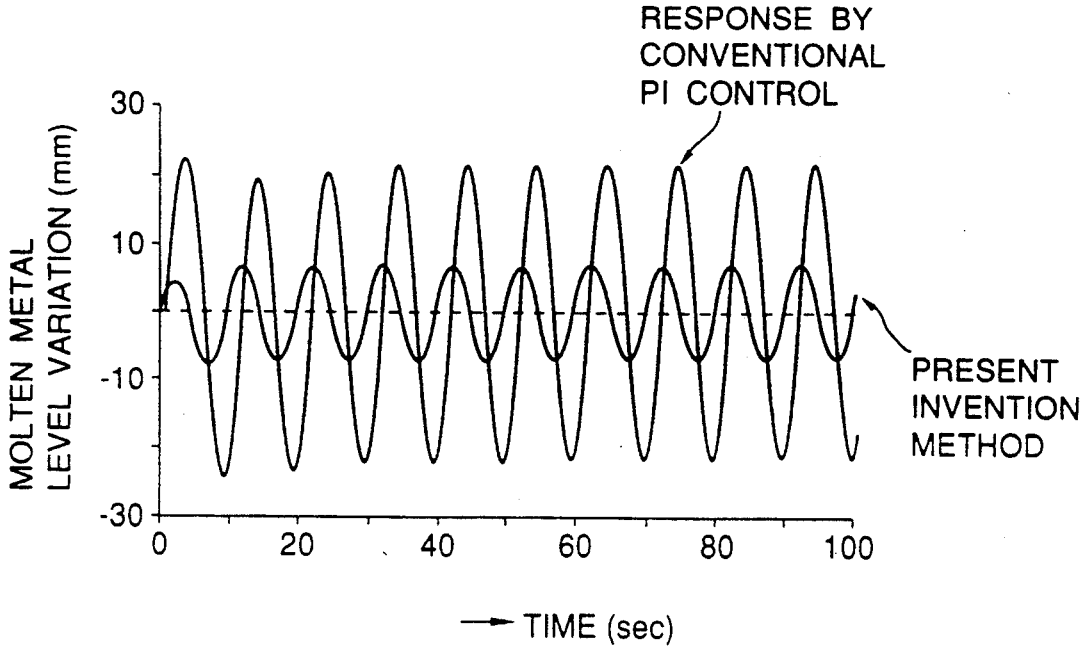

FIG. 17 shows the control characteristics for irregular bulging under the assumption that qw is a ramp-shaped flow disturbance.

As shown in FIG. 17 (A), the estimate of the flow disturbance almost completely coincides with the actual flow disturbance. FIG. 17 (B) shows that, using the control method of this embodiment, the amount of variation of the molten metal level has been reduced to a third of that in conventional PI control.

Figure 18:
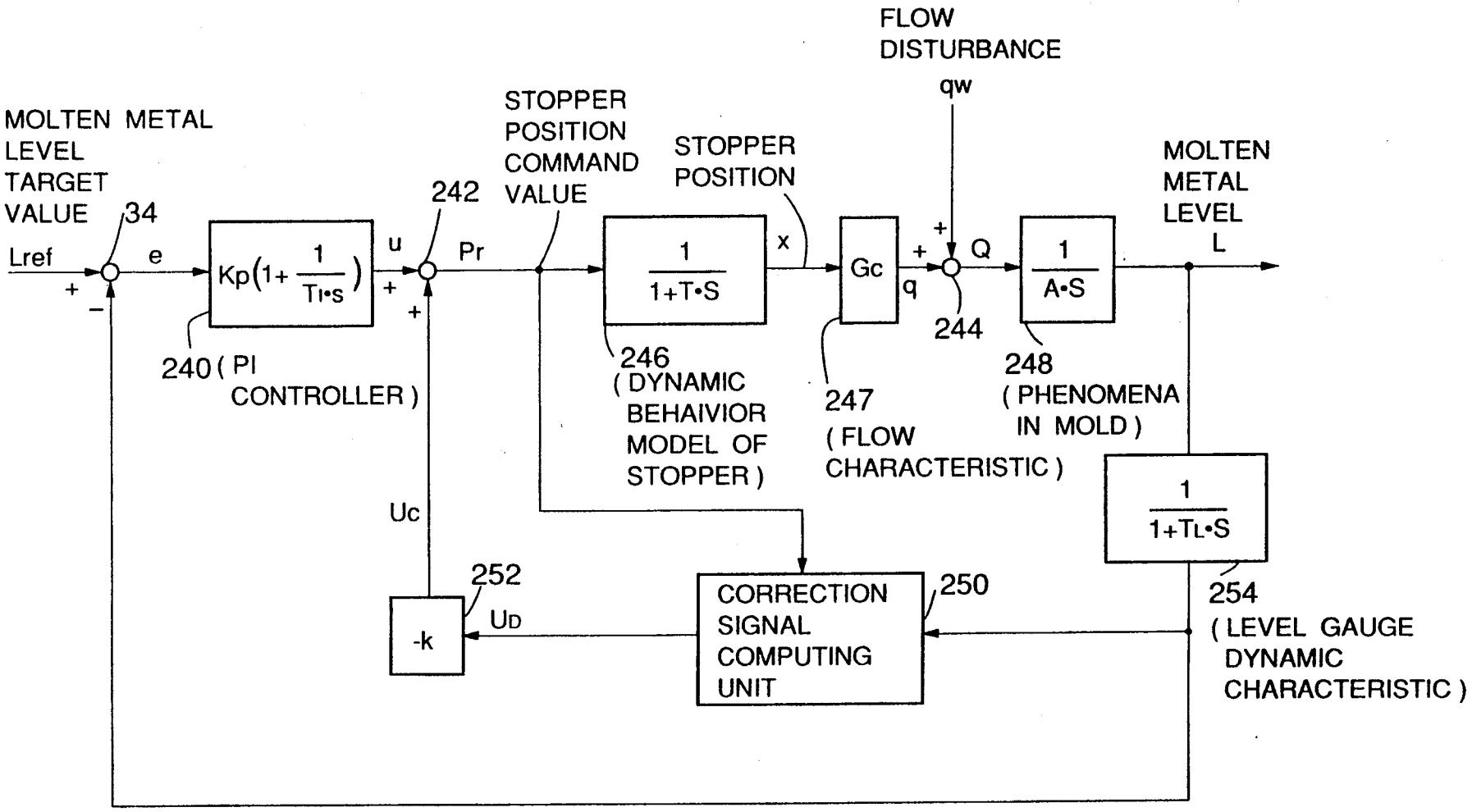
FIG. 18 is a block diagram showing the configuration of the ninth embodiment according to the present invention.

FIG. 18 is a block diagram showing the ninth embodiment according to the present invention. This embodiment, too, is realized by the application of claim 8.

In this embodiment, the dynamic behaviour 246 of the stopper is assumed to be represented by a time lag of first order. This embodiment differs from the eighth embodiment in that the correction signal computing unit 250 computes the estimate $\hat{qw}$ of the flow disturbance and the derivative $\hat{qw}$ from the stopper position command value Pr, which is output by the adder 242, and the detected value L of the molten metal level, which is entered into the correction signal computing unit 250 via the dynamic behaviour 254 of the molten metal level gauge 26.

Accordingly, the correction signal computing unit 250 of this embodiment uses the stopper position command value Pr instead of the actual stopper position value x to compute formulas (29) and (30) and output the stopper correction amount command value $U_D$.

The remaining configuration, functions and effects are the same as for the eighth embodiment. Their description will therefore be omitted.

According to the molten metal level control method for continuous casting used in the above-described eighth and ninth embodiment, the flow disturbance caused by clogging of the nozzle, peeling off of deposits in the nozzle, irregular bulging, etc and its derivative can be estimated. These estimates are used to control the molten metal level to offset flow disturbances. This therefore allows the molten metal level to be kept stable since quick and appropriate measures against all sorts of disturbances can be taken. As a result, outstanding effects such as maintaining the quality of the ingots at a good level, prevention of defects and improvement in the yield rate are achieved.

In the following the tenth embodiment according to the present invention will be described in detail.

Figure 19:
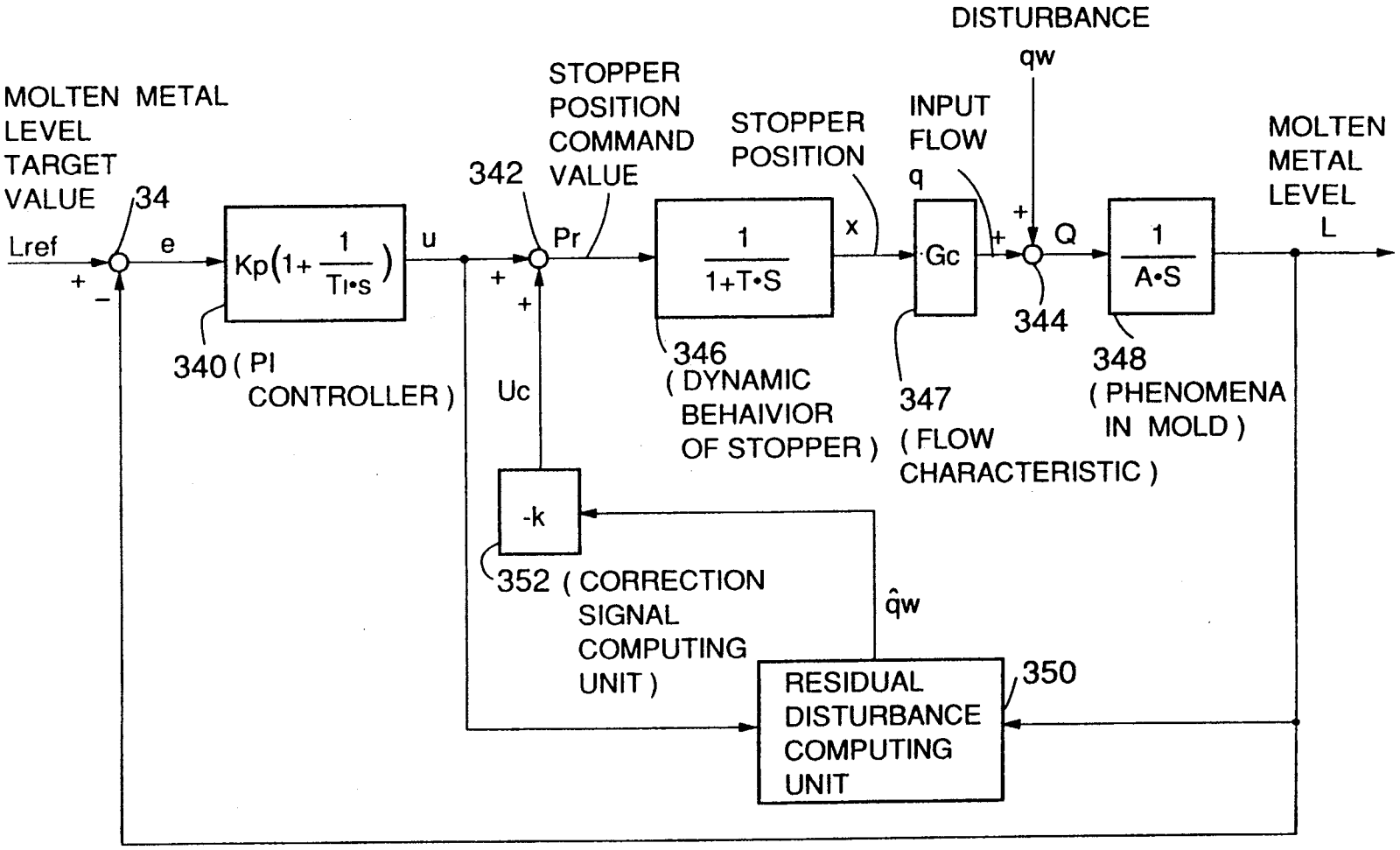
FIG. 19 is a block diagram showing the configuration of the tenth embodiment according to the present invention.

FIG. 19 is a block diagram showing the tenth embodiment according to the present invention. The continuous casting machine shown in FIG. 21 is applied to this embodiment.

For the description of this embodiment, it is assumed that the input flow control actuator is the stopper 28, that the PI controller 340 performs the molten metal level feedback control, that the dynamic behaviour 346 of the stopper is represented by a time lag of first-order, that the input flow q into the mold 18 is proportional to the actual stopper position value x (the proportional coefficient is Gc (flow gain)) and that the phenomena 48 inside the mold are represented by an integral.

In FIG. 19, reference numeral 34 denotes a comparator which compares the target value Lref of the molten metal level to the molten metal level L detected by the molten metal level gauge 26 and outputs the deviation e (e=Lref−L).

Reference numeral 340 denotes a PI controller used to perform proportional integral (PI) control. Using predetermined control parameters (proportional gain $K_P$ and integral time $T_I$), the PI controller 340 computes the stopper position command value u which gives the instruction to establish the position of the stopper 28 so as to eliminate the deviation e that is input from the comparator 34. The PI controller 340 then outputs the stopper position command value u to the adder 342.

The feedback control loop, which acts to eliminate the difference between the detected value L and the target value Lref of the molten metal level, is formed by the PI controller 340. Further, this embodiment involves an additional residual disturbance elimination control loop which is composed of a residual disturbance computing unit 350 and a correction signal computing unit 352.

The residual disturbance computing unit 350 uses the stopper position command value u, input from the PI controller 340, and the detected value L of the molten metal level to estimate the residue amount $\gamma w$ of the flow disturbance qw, which the PI controller 340 alone cannot control using feedback control. The residual disturbance computing unit 350 then outputs the estimate $\hat{\gamma w}$ of the residual disturbance to the correction signal computing unit 352.

The residual disturbance computing unit 350 assumes that the fluctuation of the molten metal level is caused by a residual disturbance, which the PI controller 340 cannot control using feedback control. It computes the estimate $\hat{\gamma w}$ of the residual disturbance using the following control model.

If no residual disturbance $\gamma w$ occurs, then the stopper position command value u and the detected value L of the molten metal level are represented by the following state equation (33), where d/dt denotes a differential operator.

$$\begin{pmatrix} dL/dt \\ dx/dt \\ dqw/dt \end{pmatrix} = \begin{pmatrix} 0, & Gc/A, & 1/A \\ 0, & -1/T, & 0 \\ 0, & 0, & 0 \end{pmatrix} \begin{pmatrix} L \\ x \\ qw \end{pmatrix} + \begin{pmatrix} 0 \\ 1/T \\ 0 \end{pmatrix} u \tag{33}$$

The residual disturbance computing unit 350 uses the stopper position command value u, input from the PI controller 340, to compute the molten metal level L according to formula (33). The computed molten metal level L is the estimate $\hat{L}$.

The residual disturbance computing unit 350 substitutes the difference between the estimate $\hat{L}$ and the detected value L of the molten metal level, the latter being input via the molten metal level gauge 26, for $(L-\hat{L})$ in the following formula (34). Then it computes the estimate $\hat{\gamma w}$ of the residual disturbance and outputs $\hat{\gamma w}$ to the correction signal computing unit 352. Here, g1, g2 and g3 denote constants.

$$\begin{pmatrix} d\hat{L}/dt \\ d\hat{x}/dt \\ d\hat{\gamma} w/dt \end{pmatrix} = \begin{pmatrix} 0, & Gc/A, & 1/A & \hat{L} \\ 0, & -1/T, & 0 & \hat{x} \\ 0, & 0, & 0 & \hat{\gamma} w \end{pmatrix} + \begin{pmatrix} 0 \\ 1/T \\ 0 \end{pmatrix} u + \begin{pmatrix} g1 \\ g2 \\ g3 \end{pmatrix} (L - \hat{L}) \tag{34}$$

The correction signal computing unit 352 multiplies the estimate $\hat{\gamma w}$ of the residual disturbance, which is output from the residual disturbance computing unit 350, by a correction coefficient −K and outputs the result, the stopper correction signal Uc, to the adder 342. That is, the stopper correction signal Uc, output from the correction signal computing unit 352, is represented by the following formula (35):

$$U_C = -K \cdot \hat{\gamma w} \tag{35}$$

The adder 342 adds the stopper position command value u and the stopper correction signal Uc and outputs the result as total (actual) stopper position command value Pr.

346 shows the dynamic behaviour of the stopper 28, which is controlled by the total stopper position command value Pr output from the adder 342 and outputs the actual position of the stopper 28 as actual stopper position value x after the stopper 28 has been controlled by the total stopper position command value Pr.

347 shows the flow characteristic of the mold 18. The input flow q of the molten steel 10 from the nozzle 16 into the mold 18 is proportional to the actual stopper position value x, which is determined by the dynamic behaviour 346 of the stopper (the flow coefficient Gc is the proportional coefficient).

344 denotes an adder which adds the disturbance qw to the input flow q when a disturbance occurs and shows that molten steel 10 of total input flow Q flows into the mold 18.

348 shows the phenomena in the mold 18 into which the total input flow Q of the molten steel 10 has flowed. The molten metal level L is determined by the total input flow Q. A denotes the cross-sectional area of the mold 18 and S denotes the Laplace operator.

In the following the function of the tenth embodiment will be described.

The comparator 34 compares the level L of the molten metal 10, which is detected by the molten metal level gauge 26, to the molten metal level target value Lref. The deviation e of L from Lref is input into the PI controller 340, which then outputs a stopper position command value u to the adder 342. u is used to eliminate the deviation e.

When a flow disturbance qw caused by phenomena such as clogging of the nozzle occurs, feedback control using only the PI controller 340 is not enough to completely eliminate the disturbance qw so that the molten metal level cannot be kept stable.

To cope with this situation, the stopper position command value u, which is output from the PI controller 340, and the detected value L of the molten metal level are input into the residual disturbance computing unit 350, which computes the estimate $\gamma w$ of the residual disturbance in accordance with the model represented by formulas (33) and (34) and then outputs $\gamma w$ to the correction signal computing unit 352. The correction signal computing unit 352 then outputs the stopper correction signal Uc to the adder 342.

The adder 342 then outputs the total stopper position command value Pr, which is the sum of the stopper position command value u and the stopper correction signal Uc, to the dynamic behaviour 346 of the stopper.

As a result, the stopper 28 is controlled to establish a position so that the residual amount $\gamma w$ of the flow disturbance qw caused by clogging of the nozzle, peeling off of deposits in the nozzle, irregular bulging, etc. is offset. The flow characteristic 347 and the phenomena 348 inside the mold indicate characteristics and phenomena which offset the residual amount $\gamma w$ of the flow disturbance.

Since the stopper 28 is controlled by the total stopper position command value Pr, the molten metal level, which is formed by molten steel 10 that has flowed from the nozzle 16 into the mold 18, remains stable for all sorts of flow disturbances qw.

Figure 20:
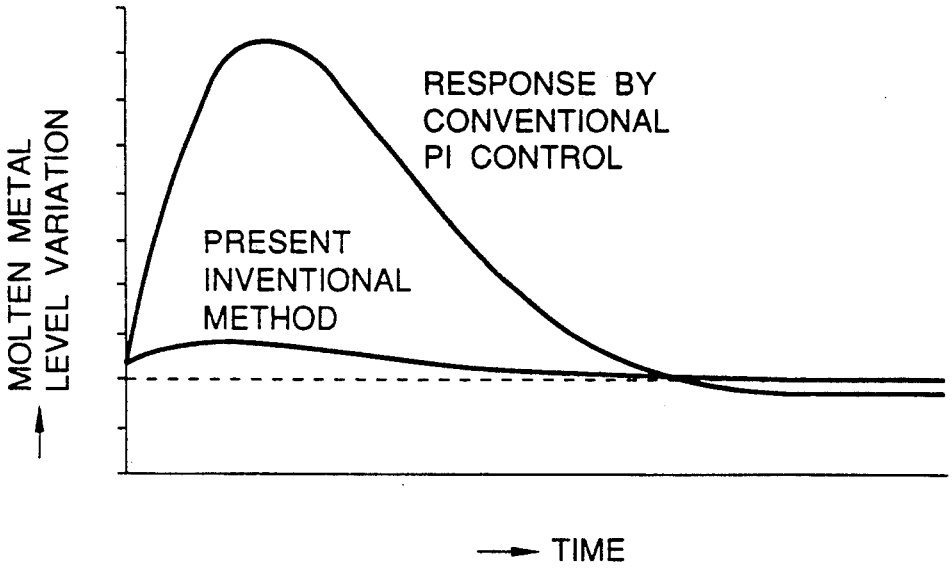
FIG. 20 is a diagram showing a comparison between the response of the tenth embodiment and the response of a conventional example.

FIG. 20 shows a comparison of control characteristics of this embodiment and control characteristics of conventional control. If the control method of this embodiment is used, then the fluctuation of the molten metal level is one third that of conventional methods.

Since the control method of this embodiment uses the estimate $\gamma w$ of the residual disturbance, which is computed by the residual disturbance computing unit 350 and the correction signal computing unit 352, to offset residual disturbances which cannot be controlled by only the feedback control of the PI controller 340, quick and appropriate measures against all sorts of disturbances can be taken to keep the molten metal level in the mold 18 stable.

As described above, the molten metal level control method for continuous casting of the tenth embodiment allows the residual amount of flow disturbances, which cannot be controlled by feedback control, to be estimated. Since a correction signal, which is used to eliminate this residual flow disturbance, is output to the actuator (stopper), rapid and appropriate measures against all sorts of disturbances can be taken to keep the molten metal level stable at any time. As a result, outstanding effects such as maintaining the quality of the ingots at a good level, the prevention of defects and improvement in the yield are obtained.

While the present invention has been described in detail by means of specific examples and in specific embodiments, the invention is not limited thereto, for obvious modifications will occur to those skilled in the art without departing from the spirit and scope of the invention.

For example, the formulas used for the sixth embodiment can be used for the model and the signal system used for the tenth embodiment can be used for the signal system.

CAPABILITY OF EXPLOITATION IN INDUSTRY

As described above, the present invention provides control by offering a systematic approach that allows a wide variety of disturbances to be treated as flow disturbances, thus providing an outstanding control which cannot be found in conventional feedback control systems.

We claim:

1. A molten metal level control method for continuous casting so that during continuous casting of ingots by a continuous casting machine, which is equipped with a flow control actuator used to control input flow of molten metal into a mold, said molten metal level control method comprises the steps of:

estimating flow fluctuations caused by disturbances of the molten metal flowing into or out of the mold on the basis of at least a measured value of the molten metal level and a measured value of position of said flow control actuator or a command value for the position of said flow control actuator from among group consisting of the measured value of the molten metal level in the mold, the measured value of the position of the flow control actuator or the command value for the position of the flow control actuator and a measured value of the casting speed, determining operation amount of said flow control actuator necessary to counterbalance the estimated flow fluctuation (disturbance), and operating said flow control actuator on the basis of the determined operation amount.

2. The molten metal level control method for continuous casting according to claim 1, wherein the method of estimation of the flow fluctuations caused by said disturbances comprises the steps of:

creating a process model, which describes variation of the molten metal level and variation of said disturbances with time, with the variation of the molten metal level being determined by accumulation of input flow variation plus flow variation caused by said disturbances in the mold and the amount of variation of the input flow being determined by characteristic relation between the position of said flow control actuator and the input flow into the mold and the amount of variation after control of the position of the flow control actuator is started, entering the measured value of the position of the flow control actuator into said process model, and feeding back an error between the estimate of the molten metal level and the measured value of the molten metal level, the former being obtained from said process model, into said process model to eliminate the difference between the estimate and the measured value, and integrating the error between the estimate and the measured value of the molten metal level arising in computation process thereby estimating the flow fluctuation caused by said disturbances.

3. The molten metal level control method for continuous casting according to claim 1, wherein the method of estimation of the flow fluctuations caused by said disturbances comprises the steps of:

creating a process model which describes variation of the molten metal level and variation of said disturbances with time, with the variation of the molten metal level being determined by accumulation of input flow variation plus flow variation caused by said disturbances in the mold, the input flow variation being determined by the position command value for said flow control actuator, characteristic of a control system of said flow control actuator, characteristic relation between the position of said flow control actuator and the input flow into the mold and amount of variation after control of the position of said flow control actuator is started, entering the flow control actuator position command value into said process model, and feeding back an error between the estimate of the molten metal level and the measured value of the molten metal level, the former being obtained from said process model, into said process model to eliminate difference between the estimate and the measured value and integrating the error between the estimate and the measured value of the molten metal level arising in computation process thereby estimating the flow fluctuation caused by said disturbances.

4. The molten metal level control method for continuous casting according to claim 1, wherein the method of estimation of the flow fluctuations caused by said disturbances comprises the steps of:

creating a process model which describes variation of the input flow, variation of the molten metal level and variation of said disturbances with time, whereby the variation of the input flow is determined by characteristic relation between the position of said flow control actuator and input flow into the mold and amount of variation after control of the position of said flow control actuator is started, and the variation of the molten metal level is determined by accumulation of difference between the input flow variation and the output flow variation, the latter being determined by amount of variation after casting speed control is started, plus flow variation caused by said disturbances in the mold, entering the measured value of the position of the flow control actuator and the measured value of the casting speed into said process model, and feeding back an error between the estimate of the molten metal level and the measured value of molten metal level, the former being obtained from said process model, into said process model to eliminate difference between the estimate and the measured value and integrating the error between the estimate and the measured value of the molten metal level arising in computation process thereby estimating the flow fluctuation caused by said disturbances.

5. The molten metal level control method for continuous casting according to claim 1, wherein the method of estimation of the flow fluctuations caused by said disturbances comprises the steps of:

creating a process model which describes variation of the input flow, variation of the molten metal level and variation of said disturbances with time, whereby the variation of the input flow is determined by the position command value for said flow control actuator, characteristic of a control system of said flow control actuator, characteristic relation between the position of said flow control actuator and the input flow into the mold and amount of variation after control of the position of said flow control actuator is started, and the variation of the molten metal level is determined by the accumulation of the difference between the input flow variation and the output flow variation, the latter being determined by amount of variation after casting speed control is started, plus flow variation caused by said disturbances in the mold, entering the flow control actuator position command value and the measured value of the casting speed into said process model, and feeding back an error between the estimate of the molten metal level and the measured value of the molten metal level, the former being obtained from said process model, into said process model to eliminate difference between the estimate and the measured value and integrating the error between the estimate and the measured value of the molten metal level arising in the computation process thereby estimating the flow fluctuation caused by said disturbances.

6. The molten metal level control method for continuous casting according to claim 1, wherein the method of estimation of the flow fluctuations caused by said disturbances comprises the steps of:

creating a model for dynamic behaviour of the actuator, which describes the dynamic behaviour from the position command value for said flow control actuator to the input flow into the mold, entering the position command value for said flow control actuator into said model for the dynamic behaviour of the actuator, estimating the input flow into the mold, estimating loss of flow balance in the mold, as total flow fluctuation, using at least the measured value of the molten metal level from among the group consisting of the measured value of the molten metal level in the mold, the measured value of the position of the actuator and the position command value for the actuator, and estimating the flow fluctuation caused by said disturbances, using difference between the estimated total flow fluctuation and the estimated input flow into the mold.

7. The molten metal level control method for continuous casting according to claim 1 comprising the steps of:

estimating the flow fluctuation caused by disturbances of the molten metal flowing into or out of the mold, determining operation amount of the actuator necessary to offset the estimated flow fluctuation by taking into consideration an operation lag of said flow control actuator, and operating said flow control actuator on the basis of said operation amount.

8. The molten metal level control method for continuous casting according to claim 1 comprising the steps of:

estimating the flow fluctuation of the molten metal flowing into or out of the mold, with the flow fluctuations caused by disturbances, under the assumption that flow fluctuations of the molten metal flowing into or out of the mold can be described by a sine-shaped or a ramp-shaped curve, determining operation amount of said flow control actuator necessary to offset the estimated flow fluctuation, using the estimated flow fluctuation and its derivative, and operating said flow control actuator on the basis of said operation amount.

9. The molten metal level control method for continuous casting according to claim 1 comprising the steps of:

while estimating said flow fluctuations, estimating a component of the flow fluctuation, caused by disturbances of the molten metal flowing into or out of the mold, which cannot be controlled (suppressed) by a feedback control loop which acts to eliminate difference between the measured value of the molten metal level and the target value of the molten metal level, using the command value, which the feedback control outputs to the flow control actuator, the measured value of the molten metal level and the model that describes dynamic behaviour from the position command value of the flow control actuator to the molten metal level in the mold, and outputting the actuator command value to the flow control actuator, as a correction signal for the command value output by the feedback control, whereby the actuator command value is used to eliminate the estimated residual amount of the flow fluctuation.

10. A molten metal level control device for continuous casting by a continuous casting machine, which is equipped with a flow control actuator used to control input flow of molten metal into a mold, said molten metal level control device comprising:

a molten metal level gauge means for measuring the molten metal level in the mold, an actuator position measuring instrument means for measuring the position of said flow control actuator, a flow disturbance estimation means for estimating flow fluctuations caused by disturbances of the molten metal flowing into or out of the mold, using values measured by said molten metal level gauge and said actuator position measuring instrument, a correction amount computing means for computing operation amount of said flow control actuator necessary to offset the estimated flow disturbance, and an actuator control means for controlling said flow control actuator on the basis of said operation amount.

11. A molten metal level control device for continuous casting by a continuous casting machine, which is equipped with a flow control actuator used to control input flow of molten metal into a mold, said molten metal level control device comprising:

a molten metal level gauge means for measuring the molten metal level in the mold, a flow disturbance estimation means for estimating flow fluctuations caused by disturbances of the molten metal flowing into or out of the mold, using a value measured by the molten metal level gauge and a position command value for said flow control actuator, a correction amount computing means for computing operation amount of said flow control actuator necessary to offset the estimated flow disturbance, and an actuator control means for controlling said flow control actuator on the basis of said operation amount.

12. A molten metal level control device for continuous casting by a continuous casting machine, which is equipped with a flow control actuator used to control input flow of molten metal into a mold, said molten metal level control device comprising:

a molten metal level gauge means for measuring the molten metal level in the mold, an actuator position measuring instrument means for measuring position of sad flow control actuator, a casting speed meter means for measuring casting speed, a flow disturbance estimation means for estimating flow fluctuation caused by disturbances of the molten metal flowing into or out of the mold, using values measured by said molten metal level gauge, said actuator position measuring instrument and said casting speed meter, a correction amount computing means for computing operation amount of said flow control actuator necessary to offset said estimated flow disturbance, and an actuator control means for controlling said flow control actuator on the basis of said operation amount.

13. A molten metal level control device for continuous casting by a continuous casting machine, which is equipped with a flow control actuator used to control input flow of molten metal into a mold, said molten metal level control device comprising:

a molten metal level gauge means for measuring molten metal level in the mold, a casting speed means for measuring casting speed, a flow disturbance estimation means for to estimating flow fluctuation caused by disturbances of the molten metal flowing into or out of the mold, using values measured by said molten metal level gauge and said the casting speed meter and a position command value for said flow control actuator, a correction amount computing means for computing operation amount of said flow control actuator necessary to offset the estimated flow disturbance, and an actuator control means for controlling said flow control actuator on the basis of said operation amount.

* * * * *